US011738557B2

(12) United States Patent
Naganuma et al.

(10) Patent No.: US 11,738,557 B2
(45) **Date of Patent: *Aug. 29, 2023**

(54) LIQUID EJECTING HEAD AND LIQUID EJECTING APPARATUS

(71) Applicant: SEIKO EPSON CORPORATION, Tokyo (JP)

(72) Inventors: Yoichi Naganuma, Matsumoto (JP); Yuma Fukuzawa, Matsumoto (JP); Shotaro Tamai, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/659,049

(22) Filed: Apr. 13, 2022

(65) Prior Publication Data

US 2022/0234356 A1 Jul. 28, 2022

Related U.S. Application Data

(63) Continuation of application No. 17/177,604, filed on Feb. 17, 2021, now Pat. No. 11,331,917.

(30) Foreign Application Priority Data

Feb. 20, 2020 (JP) ..... 2020-027010

(51) Int. Cl.
*B41J 2/14* (2006.01)
*B41J 2/175* (2006.01)

(52) U.S. Cl.
CPC ..... *B41J 2/14233* (2013.01); *B41J 2/175* (2013.01); *B41J 2002/14419* (2013.01); *B41J 2202/12* (2013.01)

(58) Field of Classification Search
CPC .... B41J 2/14233; B41J 2/175; B41J 2202/12; B41J 2002/14419; B41J 2002/14362
See application file for complete search history.

(56) References Cited

U.S. PATENT DOCUMENTS

| | | | | |
|---|---|---|---|---|
| 6,290,341 | B1 | 9/2001 | Furuhata | |
| 7,524,039 | B2 | 4/2009 | Mita | |
| 7,559,632 | B2 | 7/2009 | Kodama | |
| 10,377,136 | B2 | 8/2019 | Miyagishi | |
| 11,331,917 | B2 * | 5/2022 | Naganuma | B41J 2/175 |
| 2001/0033313 | A1 | 10/2001 | Ohno | |
| 2013/0233939 | A1 | 9/2013 | Uezawa | |

FOREIGN PATENT DOCUMENTS

JP 2013-184372 A 9/2013

* cited by examiner

*Primary Examiner* — An H Do
(74) *Attorney, Agent, or Firm* — WORKMAN NYDEGGER

(57) ABSTRACT

The nozzle channel includes a first portion that extends in the first direction and communicates with the first communication channel and a second portion that extends in a third direction crossing the first direction and orthogonal to the second direction and communicates with the first portion, and an angle formed between the first direction and the third direction is larger than 0° and smaller than 90°.

15 Claims, 20 Drawing Sheets

LIQUID EJECTING HEAD AND LIQUID EJECTING APPARATUS

The present application is a continuation of U.S. patent application Ser. No. 17/177,604, filed Feb. 17, 2021, which is based on, and claims priority from JP Application Serial Number 2020-027010, filed Feb. 20, 2020, the disclosures of which are hereby incorporated by reference herein in their entirety.

BACKGROUND

1. Technical Field

The present disclosure relates to a liquid ejecting head and a liquid ejecting apparatus.

2. Related Art

As described in JP-A-2013-184372, techniques of liquid ejecting heads that supply a liquid in a pressure chamber to a nozzle channel and eject the liquid from a nozzle that communicates with the nozzle channel have been known.

According to the related art described above, there is a possibility that a change in internal pressure of a certain nozzle channel has an influence on ink ejection of a nozzle channel adjacent to the certain nozzle channel and that the quality of an image formed by ink dots is deteriorated. When thickness of a partition between nozzle channels increases, the influence on the nozzle channel adjacent to the certain nozzle channel is reduced. However, the increase in thickness of the partition results in an increase in pitch at which nozzles are provided, and dot resolution may be lowered.

SUMMARY

A liquid ejecting head according to a preferred aspect of the disclosure includes: a first pressure chamber that extends in a first direction and applies pressure to a liquid; a second pressure chamber that extends in the first direction and applies pressure to the liquid; a nozzle channel that communicates with a nozzle for ejecting the liquid; a first communication channel that extends in a second direction orthogonal to the first direction and enables the first pressure chamber and the nozzle channel to communicate with each other; and a second communication channel that extends in the second direction and enables the second pressure chamber and the nozzle channel to communicate with each other, in which the nozzle channel includes a first portion that extends in the first direction and communicates with the first communication channel and a second portion that extends in a third direction crossing the first direction and orthogonal to the second direction and communicates with the first portion, and an angle formed between the first direction and the third direction is larger than 0° and smaller than 90°.

A liquid ejecting apparatus according to a preferred aspect of the disclosure includes: a first pressure chamber that extends in a first direction and applies pressure to a liquid; a second pressure chamber that extends in the first direction and applies pressure to the liquid; a nozzle channel that communicates with a nozzle for ejecting the liquid; a first communication channel that extends in a second direction orthogonal to the first direction and enables the first pressure chamber and the nozzle channel to communicate with each other; and a second communication channel that extends in the second direction and enables the second pressure chamber and the nozzle channel to communicate with each other, in which the nozzle channel includes a first portion that extends in the first direction and communicates with the first communication channel and a second portion that extends in a third direction crossing the first direction and orthogonal to the second direction and communicates with the first portion, and an angle formed between the first direction and the third direction is larger than 0° and smaller than 90°.

DESCRIPTION OF EXEMPLARY EMBODIMENTS

Figure 1:
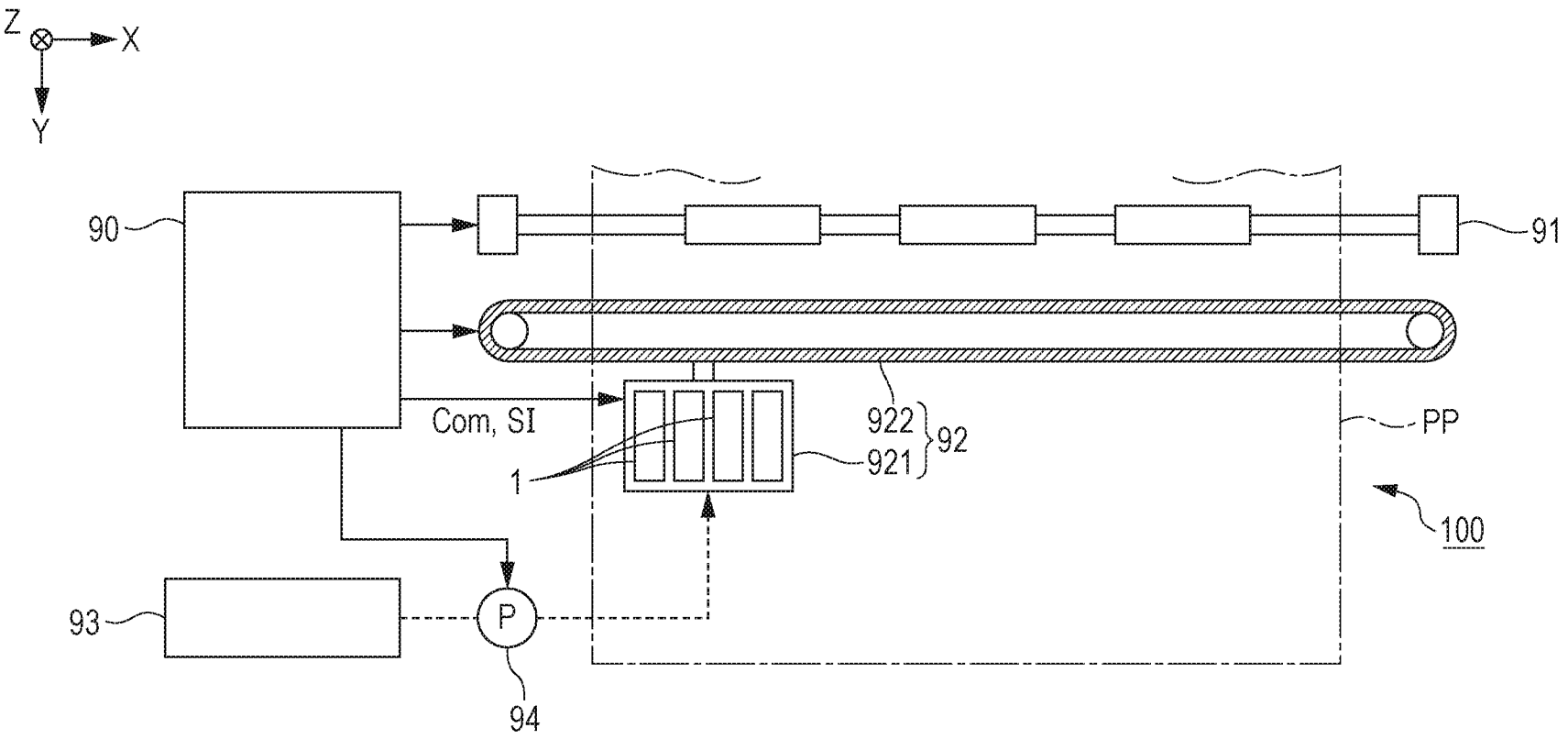
FIG. 1 is a view for explaining an example of a liquid ejecting apparatus 100 according to an embodiment.

An embodiment of the disclosure will be described below with reference to the drawings. Note that, in the drawings, dimensions and scales of components appropriately differ from actual ones. Since the embodiment described below is a preferred specific example of the disclosure, various limitations that are desirable from a technical viewpoint are added. However, the scope of the disclosure is not limited to the embodiment as long as there is no description particularly limiting the disclosure in the following description.

1. Embodiment

A liquid ejecting apparatus 100 according to the present embodiment will be described below with reference to FIG. 1.

1.1. Outline of Liquid Ejecting Apparatus 100

FIG. 1 is a view for explaining an example of the liquid ejecting apparatus 100 according to the present embodiment. The liquid ejecting apparatus 100 according to the present embodiment is an ink jet printing apparatus that ejects ink onto a medium PP. Although the medium PP is typically a printing sheet, any printing object made from a resin film, fabric, or the like can be used as the medium PP.

As illustrated in FIG. 1, the liquid ejecting apparatus 100 includes a liquid container 93 that accumulates ink. As the liquid container 93, for example, a cartridge detachably attachable to the liquid ejecting apparatus 100, a bag-like ink pack formed from a flexible film, or an ink tank that is able to be replenished with ink is able to be adopted. The liquid container 93 accumulates a plurality of types of inks of different colors.

As illustrated in FIG. 1, the liquid ejecting apparatus 100 includes a control device 90, a moving mechanism 91, a transport mechanism 92, and a circulation mechanism 94.

Among these, the control device 90 includes, for example, a processing circuit such as a CPU or FPGA and a storage circuit such as semiconductor memory and controls respective elements of the liquid ejecting apparatus 100. Here, "CPU" is an abbreviation for central processing unit, and "FPGA" is an abbreviation for field programmable gate array.

The moving mechanism 91 transports the medium PP in the +Y direction in accordance with control of the control device 90. Note that, in the following description, the +Y direction and the −Y direction, which is opposite to the +Y direction, are collectively referred to as the Y-axis direction.

The transport mechanism 92 causes a plurality of liquid ejecting heads 1 to be reciprocated in the +X direction and the −X direction, which is opposite to the +X direction, in accordance with control of the control device 90. Note that, in the following description, the +X direction and the −X direction are collectively referred to as the X-axis direction. Here, the +X direction is a direction crossing the +Y direction. The +X direction is typically a direction orthogonal to the +Y direction. The transport mechanism 92 includes a storage case 921 that houses the plurality of liquid ejecting heads 1 and an endless belt 922 to which the storage case 921 is fixed. Note that the liquid container 93 may be housed in the storage case 921 together with the liquid ejecting heads 1.

The circulation mechanism 94 supplies the ink, which is accumulated in the liquid container 93, to a supply channel RB1 provided in a liquid ejecting head 1 in accordance with control of the control device 90. Further, in accordance with control of the control device 90, the circulation mechanism 94 collects ink accumulated in a discharge channel RB2 provided in the liquid ejecting head 1 and causes the collected ink to return to the supply channel RB1. Note that the supply channel RB1 and the discharge channel RB2 will be described later with reference to FIG. 3.

As illustrated in FIG. 1, a driving signal Com for driving the liquid ejecting head 1 and a control signal SI for controlling the liquid ejecting head 1 are supplied from the control device 90 to the liquid ejecting head 1. Then, in accordance with control with the control signal SI, the liquid ejecting head 1 is driven with the driving signal Com to supply the ink, which is supplied to the supply channel RB1, to a nozzle channel RN provided in the liquid ejecting head 1 and to eject the ink in the +Z direction from a portion of or all M nozzles N provided in the liquid ejecting head 1. Here, a value of M is a natural number of 1 or more.

The +Z direction is a direction orthogonal to the +X direction and the +Y direction. In the following description, the +Z direction and the −Z direction, which is opposite to the +Z direction, are collectively referred to as the Z-axis direction in some cases. Note that the nozzles N will be described later with reference to FIGS. 2 and 3. The nozzle channel will be described later with reference to FIG. 3. In conjunction with transport of the medium PP by the moving mechanism 91 and reciprocation of the liquid ejecting head 1 by the transport mechanism 92, the liquid ejecting head 1 ejects the ink from a portion of or all the M nozzles N and causes the ejected ink to land on the surface of the medium PP to thereby form a desired image on the surface of the medium PP.

1.2. Outline of Liquid Ejecting Head

An outline of the liquid ejecting head 1 will be described below with reference to FIGS. 2 to 6.

Figure 2:
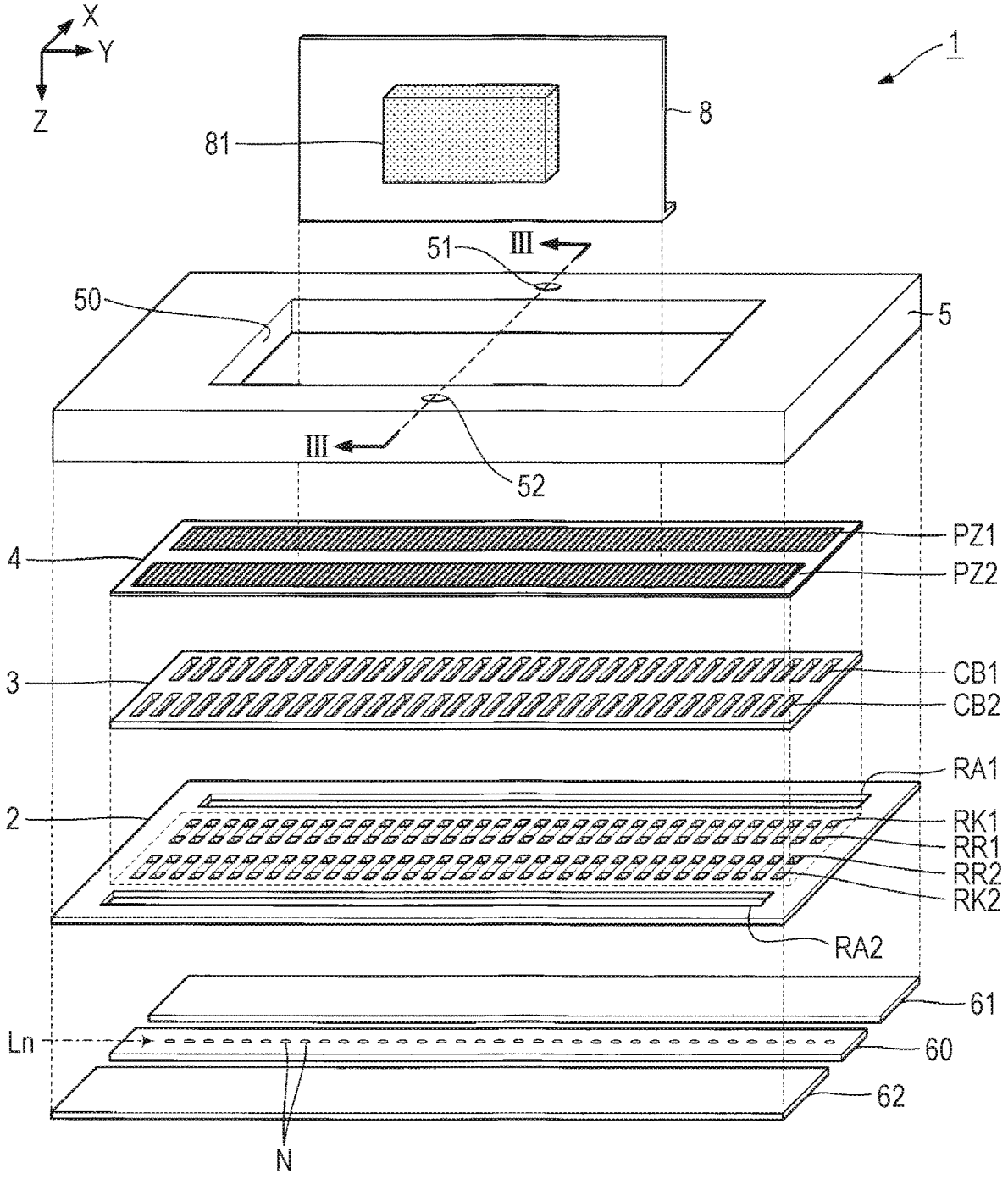
FIG. 2 is an exploded perspective view of a liquid ejecting head 1.
Figure 3:
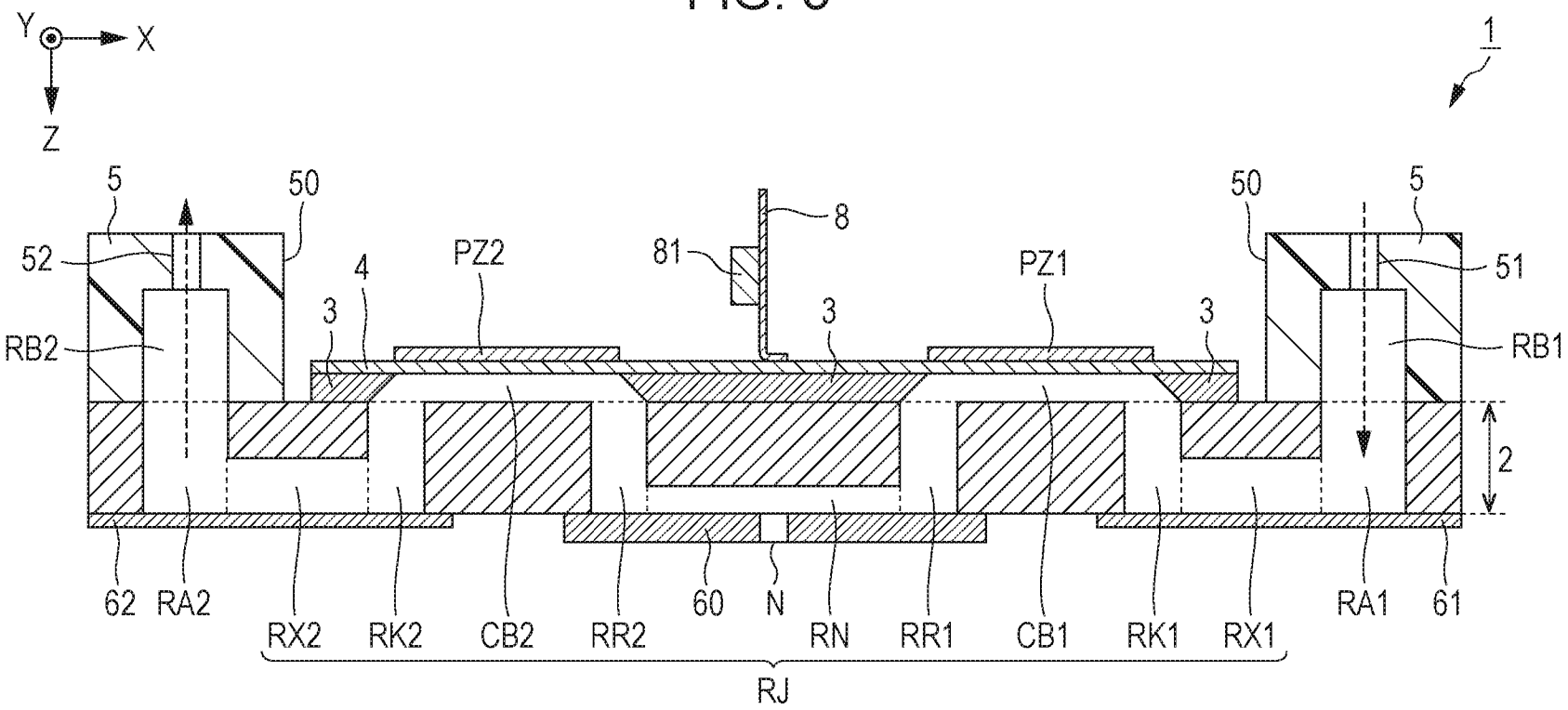
FIG. 3 is a sectional view along line III-III in FIG. 2.

FIG. 2 is an exploded perspective view of the liquid ejecting head 1. FIG. 3 is a sectional view along line III-III in FIG. 2. Line III-III is a virtual line segment passing through the nozzle channel RN.

As illustrated in FIGS. 2 and 3, the liquid ejecting head 1 includes a nozzle substrate 60, a compliance sheet 61, a compliance sheet 62, a communication plate 2, a pressure chamber substrate 3, a vibrating plate 4, an accumulation chamber forming substrate 5, and a wiring substrate 8.

As illustrated in FIGS. 2 and 3, the communication plate 2 is provided on the −Z side of the nozzle substrate 60. The communication plate 2 is a plate member, which is elongated in the Y-axis direction and extends substantially parallel to the X-Y plane, and has an ink channel formed therein.

Specifically, one supply channel RA1 and one discharge channel RA2 are formed in the communication plate 2. Of the supply channel RA1 and the discharge channel RA2, the supply channel RA1 communicates with the supply channel RB1 described later and is provided so as to extend in the Y-axis direction. The discharge channel RA2 communicates with the discharge channel RB2 described later and is provided, in the −X direction as viewed from the supply channel RA1, so as to extend in the Y-axis direction.

In the communication plate 2, M coupling channels RK1 corresponding on a one-to-one basis to the M nozzles N, M coupling channels RK2 corresponding on a one-to-one basis to the M nozzles N, M communication channels RR1 corresponding on a one-to-one basis to the M nozzles N, M communication channels RR2 corresponding on a one-to-one basis to the M nozzles N, M nozzle channels RN corresponding on a one-to-one basis to the M nozzles N, M coupling channels RX1 corresponding on a one-to-one basis to the M nozzles N, and M coupling channels RX2 corresponding on a one-to-one basis to the M nozzles N are formed.

Note that one coupling channel RX1 may be provided in common to the M nozzles, and one coupling channel RX2 may be provided in common to the M nozzles. The following description will be given by assuming that the M coupling channels RX1 and the M coupling channels RX2 are provided.

In the following description, a nozzle N in the m-th position as viewed in the −Y direction among the M nozzles N is sometimes expressed as a nozzle N[m] when m is a natural number of 1 or more and M or less. A coupling channel RK1 corresponding to the nozzle N[m] is sometimes expressed as a coupling channel RK1[*m*]. A coupling channel RK2 corresponding to the nozzle N[m] is sometimes expressed as a coupling channel RK2[*m*]. A communication channel RR1 corresponding to the nozzle N[m] is sometimes expressed as a communication channel RR1[*m*]. A communication channel RR2 corresponding to the nozzle N[m] is sometimes expressed as a communication channel RR2[*m*]. A nozzle channel RN corresponding to the nozzle N[m] is sometimes expressed as a nozzle channel RN[m]. The nozzle N[m] is provided in the nozzle channel RN[m].

The coupling channel RX1 communicates with the supply channel RA1 and is provided, in the −X direction as viewed from the supply channel RA1, so as to extend in the X-axis direction. The coupling channel RK1 communicates with the coupling channel RX1 and is provided, in the −X direction as viewed from the coupling channel RX1, so as to extend in the Z-axis direction. The communication channel RR1 is provided, in the −X direction as viewed from the coupling channel RK1, so as to extend in the Z-axis direction. The coupling channel RK2 communicates with the coupling channel RX2 and is provided, in the +X direction as viewed from the coupling channel RX2, so as to extend in the Z-axis direction. The coupling channel RX2 communicates with the discharge channel RA2 and is provided, in the +X direction as viewed from the discharge channel RA2, so as to extend in the X-axis direction. The communication channel RR2 is provided, in the +X direction as viewed from the coupling channel RK2 and in the −X direction as viewed from the communication channel RR1, so as to extend in the Z-axis direction. The nozzle channel RN enables the communication channel RR1 and the communication channel RR2 to communicate with each other. The nozzle channel RN is positioned between a pressure chamber CB1 and a pressure chamber CB2 as viewed in the −Z direction. The nozzle channel RN communicates with the nozzle N corresponding to the nozzle channel RN.

Note that the communication plate 2 is manufactured such that, for example, a silicon monocrystalline substrate is processed by using a semiconductor manufacturing technique. Note that any known material and process can be adopted to manufacture the communication plate 2.

Description will be given with reference back to FIGS. 2 and 3. As illustrated in FIGS. 2 and 3, the pressure chamber substrate 3 is provided on the −Z side of the communication plate 2. The pressure chamber substrate 3 is a plate member, which is elongated in the Y-axis direction and extends substantially parallel to the X-Y plane, and has an ink channel formed therein.

Specifically, in the pressure chamber substrate 3, M pressure chambers CB1 corresponding on a one-to-one basis to the M nozzles N and M pressure chambers CB2 corresponding on a one-to-one basis to the M nozzles N are formed. Among these, the pressure chamber CB1 enables the coupling channel RK1 and the communication channel RR1 to communicate with each other and is provided, as viewed in the Z-axis direction, so as to couple an end of the coupling channel RK1 on the +X side and an end of the communication channel RR1 on the −X side and extend in the X-axis direction. The pressure chamber CB2 enables the coupling channel RK2 and the communication channel RR2 to communicate with each other and is provided, as viewed in the Z-axis direction, so as to couple an end of the coupling channel RK2 on the −X side and an end of the communication channel RR2 on the +X side and extend in the X-axis direction.

In the following description, the pressure chamber CB1 corresponding to the nozzle N[m] is sometimes expressed as a pressure chamber CB1[*m*]. The pressure chamber CB2 corresponding to the nozzle N[m] is sometimes expressed as a pressure chamber CB2[*m*].

Note that the pressure chamber substrate 3 is manufactured such that, for example, a silicon monocrystalline substrate is processed by using a semiconductor manufacturing technique. Note that any known material and process can be adopted to manufacture the pressure chamber substrate 3.

Note that, in the following description, an ink channel that enables the supply channel RA1 and the discharge channel RA2 to communicate with each other is referred to as a circulation channel RJ. That is, M circulation channels RJ corresponding on a one-to-one basis to the M nozzles N enable the supply channel RA1 and the discharge channel RA2 to communicate with each other. Each of the circulation channels RJ includes the coupling channel RX1 that communicates with the supply channel RA1, the coupling channel RK1 that communicates with the coupling channel RX1, the pressure chamber CB1 that communicates with the coupling channel RK1, the communication channel RR1 that communicates with the pressure chamber CB1, the nozzle channel RN that communicates with the communication channel RR1, the communication channel RR2 that communicates with the nozzle channel RN, the pressure chamber CB2 that communicates with the communication channel RR2, the coupling channel RK2 that communicates with the pressure chamber CB2, and the coupling channel RX2 that communicates with the coupling channel RK2 and the discharge channel RA2, as described above.

As illustrated in FIGS. 2 and 3, the vibrating plate 4 is provided on the −Z side of the pressure chamber substrate 3. The vibrating plate 4 is a plate member, which is elongated in the Y-axis direction and extends substantially parallel to the X-Y plane, and is a member capable of elastically vibrating.

As illustrated in FIGS. 2 and 3, M piezoelectric elements PZ1 corresponding on a one-to-one basis to the M pressure chambers CB1 and M piezoelectric elements PZ2 corresponding on a one-to-one basis to the M pressure chambers CB2 are provided on the −Z side of the vibrating plate 4. In the following description, a piezoelectric element PZ1 and a piezoelectric element PZ2 are collectively referred to as a piezoelectric element PZq. The piezoelectric element PZq is a passive element that is deformed in accordance with a change in the potential of the driving signal Com. In other words, the piezoelectric element PZq is an example of an energy conversion element that converts electrical energy of the driving signal Com into kinetic energy. Note that, in the following description, components and signals of the liquid ejecting head 1, which correspond to the piezoelectric element PZq, are sometimes suffixed with "q".

Figure 4:
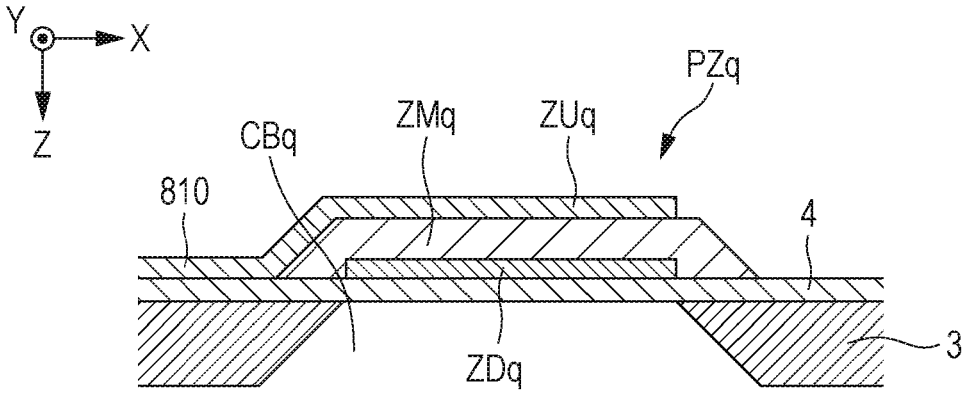
FIG. 4 is an enlarged sectional view of the vicinity of a piezoelectric element PZq.

FIG. 4 is an enlarged sectional view of the vicinity of the piezoelectric element PZq.

As illustrated in FIG. 4, the piezoelectric element PZq is a layered structure in which a piezoelectric material ZMq is interposed between a lower electrode ZDq to which a given reference potential VBS is supplied and an upper electrode ZUq to which the driving signal Com is supplied. The piezoelectric element PZq is, for example, a portion in which the lower electrode ZDq, the upper electrode ZUq, and the piezoelectric material ZMq overlap each other as viewed in the −Z direction. Moreover, a pressure chamber CBq is provided in the +Z direction of the piezoelectric element PZq.

As described above, the piezoelectric element PZq is driven and deformed in accordance with the change in the potential of the driving signal Com. The vibrating plate 4 vibrates with the deformation of the piezoelectric element PZq. When the vibrating plate 4 vibrates, the pressure in the pressure chamber CBq changes. The change in the pressure in the pressure chamber CBq enables the ink filled in the pressure chamber CBq to be ejected from the nozzle N via a communication channel RRq and the nozzle channel RN.

As illustrated in FIGS. 2 and 3, the wiring substrate 8 is mounted on the surface of the vibrating plate 4 on the −Z side. The wiring substrate 8 is a part for electrically coupling the control device 90 and the liquid ejecting head 1. As the wiring substrate 8, for example, a flexible wiring substrate such as an FPC or FFC is suitably adopted. Here, "FPC" is an abbreviation for flexible printed circuit, and "FFC" is an abbreviation for flexible flat cable. A drive circuit 81 is mounted on the wiring substrate 8. The drive circuit 81 is an electrical circuit that switches between supplying and not supplying the driving signal Com to the piezoelectric element PZq in accordance with control with the control signal SI. As illustrated in FIG. 4, the drive circuit 81 supplies the driving signal Com to the upper electrode ZUq of the piezoelectric element PZq via a wire 810.

Note that, in the following description, the driving signal Com supplied to the piezoelectric element PZ1 is sometimes referred to as a driving signal Com1, and the driving signal Com supplied to the piezoelectric element PZ2 is sometimes referred to as a driving signal Com2. In the present embodiment, a case in which a waveform of the driving signal Com1 supplied from the drive circuit 81 to the piezoelectric element PZ1 corresponding to the nozzle N and a waveform of the driving signal Com2 supplied from the drive circuit 81 to the piezoelectric element PZ2 corresponding to the nozzle N are substantially identical when the ink is ejected from the nozzle N is assumed. Here, the term "substantially identical" includes not only a case of being exactly identical but also a case of being regarded as identical within a tolerance.

As illustrated in FIGS. 2 and 3, the accumulation chamber forming substrate 5 is provided on the −Z side of the communication plate 2. The accumulation chamber forming substrate 5 is a member, which is elongated in the Y-axis direction, and has an ink channel formed therein.

Specifically, one supply channel RB1 and one discharge channel RB2 are formed in the accumulation chamber forming substrate 5. Of the supply channel RB1 and the discharge channel RB2, the supply channel RB1 communicates with the supply channel RA1 and is provided, in the −Z direction as viewed from the supply channel RA1, so as to extend in the Y-axis direction. The discharge channel RB2 communicates with the discharge channel RA2 and is provided, in the −Z direction as viewed from the discharge channel RA2 and in the −X direction as viewed from the supply channel RB1, so as to extend in the Y-axis direction.

Further, an inlet port 51 that communicates with the supply channel RB1 and a discharge port 52 that communicates with the discharge channel RB2 are provided in the accumulation chamber forming substrate 5. The ink is supplied from the liquid container 93 to the supply channel RB1 via the inlet port 51. The ink accumulated in the discharge channel RB2 is collected via the discharge port 52.

An opening 50 is provided in the accumulation chamber forming substrate 5. The pressure chamber substrate 3, the vibrating plate 4, and the wiring substrate 8 are provided inside the opening 50.

Note that the accumulation chamber forming substrate 5 is formed, for example, by injection molding of a resin material. Note that any known material and process can be adopted to manufacture the accumulation chamber forming substrate 5.

In the present embodiment, the ink supplied from the liquid container 93 to the inlet port 51 flows to the supply channel RA1 via the supply channel RB1. Then, a portion of the ink flowing to the supply channel RA1 flows into the pressure chamber CB1 via the coupling channel RX1 and the coupling channel RK1. A portion of the ink flowing into the pressure chamber CB1 flows into the pressure chamber CB2 via the communication channel RR1, the nozzle channel RN, and the communication channel RR2. Then, a portion of the ink flowing into the pressure chamber CB2 is discharged from the discharge port 52 via the coupling channel RK2, the coupling channel RX2, the discharge channel RA2, and the discharge channel RB2.

Note that, when the piezoelectric element PZ1 is driven with the driving signal Com1, a portion of the ink filled in the pressure chamber CB1 is ejected from the nozzle N via the communication channel RR1 and the nozzle channel RN. When the piezoelectric element PZ2 is driven with the driving signal Com2, a portion of the ink filled in the pressure chamber CB2 is ejected from the nozzle N via the communication channel RR2 and the nozzle channel RN.

As illustrated in FIGS. 2 and 3, the compliance sheet 61 is provided on the surface of the communication plate 2 on the +Z side so as to block the supply channel RA1, the coupling channel RX1, and the coupling channel RK1. The compliance sheet 61 is formed of an elastic material and absorbs a change in the pressure of the ink in the supply channel RA1, the coupling channel RX1, and the coupling channel RK1. Additionally, the compliance sheet 62 is provided on the surface of the communication plate 2 on the +Z side so as to block the discharge channel RA2, the coupling channel RX2, and the coupling channel RK2. The compliance sheet 62 is formed of an elastic material and absorbs a change in the pressure of the ink in the discharge channel RA2, the coupling channel RX2, and the coupling channel RK2.

As described above, the liquid ejecting head 1 according to the present embodiment causes the ink to circulate from the supply channel RA1 to the discharge channel RA2 via the circulation channel RJ. Therefore, in the present embodiment, even when a period during which the ink in the pressure chamber CBq is not ejected from the nozzle N exists, it is possible to prevent the ink from continuously remaining in the pressure chamber CBq, the nozzle channel RN, or the like. Thus, in the present embodiment, even when a period during which the ink in the pressure chamber CBq is not ejected from the nozzle N exists, it is possible to suppress an increase in viscosity of the ink in the pressure chamber CBq, thus making it possible to prevent an occurrence of an ejection abnormality that makes it difficult for the ink to be ejected from the nozzle N due to an increase in viscosity of the ink.

Moreover, the liquid ejecting head 1 according to the present embodiment is able to eject, from the nozzle N, the ink filled in the pressure chamber CB1 and the ink filled in the pressure chamber CB2. Therefore, the liquid ejecting head 1 according to the present embodiment is able to increase the amount of the ink ejected from the nozzle N, for example, compared with an aspect in which ink filled in only one pressure chamber CBq is ejected from the nozzle N.

1.3. Shape of Nozzle Channel

Figure 5:
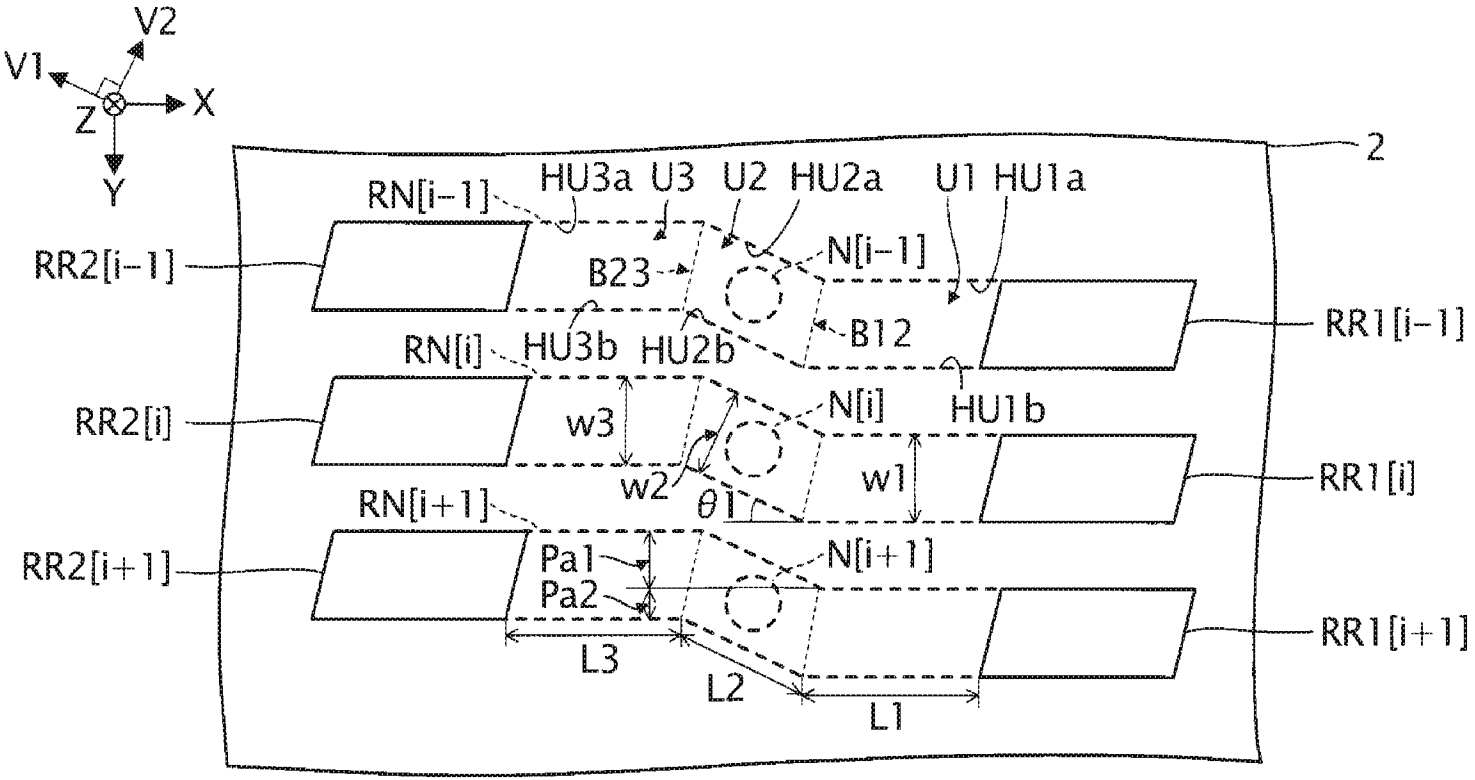
FIG. 5 is an enlarged plan view of the vicinity of a nozzle channel RN[i].

FIG. 5 is an enlarged plan view of the vicinity of a nozzle channel RN[i], in which i is a natural number of 2 or more and M−1 or less. FIG. 5 illustrates a communication channel RR1[*i*−1], a nozzle channel RN[i−1], a communication channel RR2[*i*−1], a communication channel RR1[*i*], the nozzle channel RN[i], a communication channel RR2[*i*], a communication channel RR1[*i*+1], a nozzle channel RN[i+1], and a communication channel RR2[*i*+1]. In the example of FIG. 5, the shape of each of the communication channel RR1 and the communication channel RR2 is a parallelogram in plan view in the −Z direction for convenience of processing of a monocrystalline substrate but may be a rectangle.

The nozzle channel RN has a first portion U1, a second portion U2, and a third portion U3. In FIG. 5, of the nozzle channel RN[i−1], the nozzle channel RN[i], and the nozzle channel RN[i+1], the first portion U1, the second portion U2, and the third portion U3 of the nozzle channel RN[i−1] are given reference numerals to avoid complication of the drawing. The first portion U1 extends in the −X direction and communicates with the communication channel RR1. The second portion U2 extends in the V1 direction and communicates with the first portion U1. The third portion U3 extends in the −X direction and communicates with the second portion U2 and the communication channel RR2. The V1 direction crosses the −X direction and is orthogonal to the −Z direction. Angle θ1 formed between the −X direction and the V1 direction is larger than 0° and smaller than 90°.

The nozzle N is provided in the second portion U2. The nozzle N is typically provided at a substantially central position of the second portion U2. For example, a distance from the nozzle N to a wall surface HU2*a* in the V2 direction is substantially identical to a distance from the nozzle N to a wall surface HU2*b* in the direction opposite to the V2 direction. Moreover, for example, a distance from the nozzle N to a boundary B12 between the first portion U1 and the second portion U2 in the V1 direction is substantially identical to a distance from the nozzle N to a boundary B23 between the second portion U2 and the third portion U3 in the V1 direction. Here, the term "substantially central position" includes not only a case of being strictly the center but also a case of being regarded as the center within a tolerance. The V2 direction is a direction on the −Y side of two directions vertical to the V1 direction and the −Z direction.

As illustrated in FIG. 5, as viewed in the Z-axis direction, the first portion U1 has a wall surface HU1*a* on the −Y side and a wall surface HU1*b* on the +Y side, and the second portion U2 has the wall surface HU2*a* on the V2 side and the wall surface HU2*b* on the side opposite to the V2 direction. The third portion U3 as viewed in the Z-axis direction has a wall surface HU3*a* on the −Y side and a wall surface HU3*b* on the +Y side.

Angle θ1 is also able to be expressed as an angle formed by a vector normal to the wall surface HU1*b* of the first portion U1 and oriented to the wall surface HU1*a* and a vector normal to the wall surface HU2*b* of the second portion U2 and oriented to the wall surface HU2*a*. The V1 direction is also able to be expressed as a direction rotated clockwise by angle θ1 from the −X direction as viewed in the −Z direction. Angle θ1 is larger than 10° and smaller than 50°. Further, angle θ1 is larger than 20° and smaller than 40°. Angle θ1 is typically 30°.

In the present embodiment, the first portion U1, the second portion U2, and the third portion U3 are substantially equal to each other in channel width. Here, the channel width is a dimension of a channel in a direction vertical to a direction in which the channel extends. The direction vertical to the direction in which the channel extends may be a horizontal direction or may be a vertical direction, that is, the Z-axis direction. In the following description, the channel width is a dimension of the channel in the horizontal direction which is assumed to be the direction vertical to the direction in which the channel extends. As illustrated in FIG. 5, channel width w1 of the first portion U1 in the −Y direction, channel width w2 of the second portion U2 in the V2 direction, and channel width w3 of the third portion U3 in the −Y direction are substantially equal to each other. The term "substantially equal" includes not only a case of being exactly equal but also a case of being regarded as equal within a tolerance.

In the present embodiment, channel length L2 of the second portion U2 is shorter than channel length L1 of the first portion U1 and channel length L3 of the third portion U3. Here, the channel length is a dimension in the direction in which the channel extends. Further, channel length L1 and channel length L3 are substantially equal to each other.

A portion of the communication channel RR2 overlaps and the other portion does not overlap the communication channel RR1 corresponding to the communication channel RR2 as viewed in the −X direction. In the example of FIG. 5, a portion Pa1 of the communication channel RR2[*i*+1] in the −X direction does not overlap the communication channel RR1[*i*+1], and a portion Pa2 of the communication channel RR2[*i*+1] in the −X direction overlaps the communication channel RR1[*i*+1].

Figure 6:
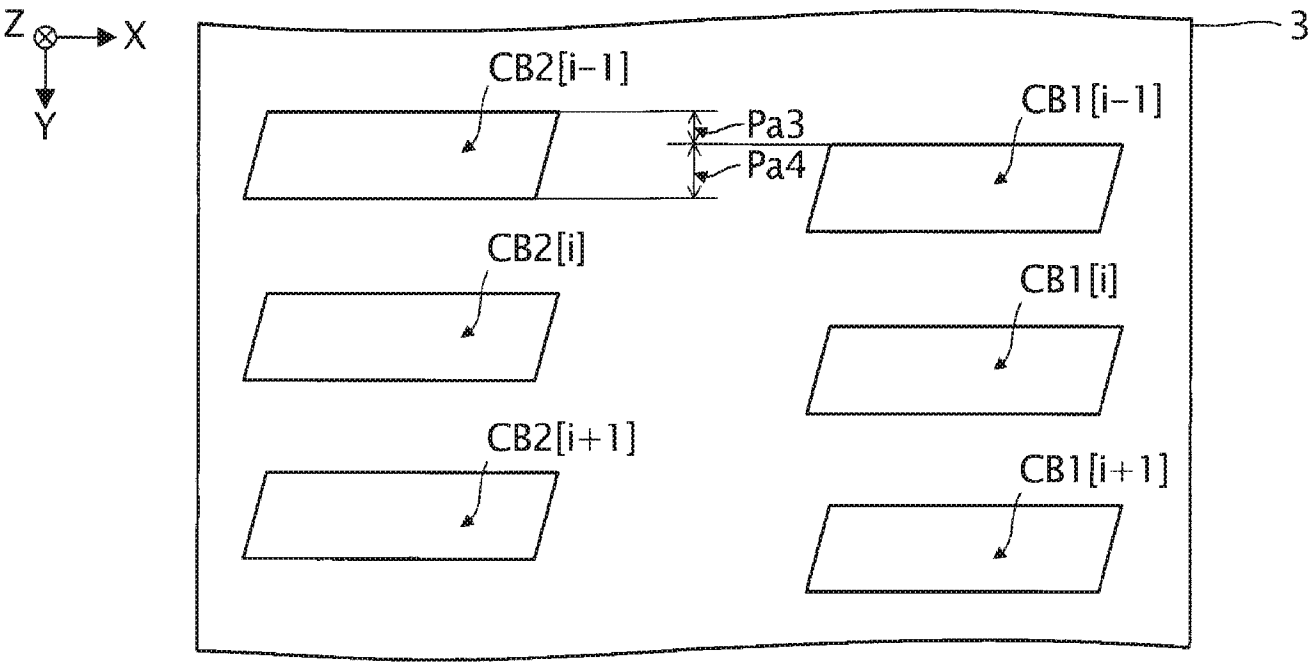
FIG. 6 is an enlarged plan view of the vicinity of a pressure chamber CB1[*i*] and a pressure chamber CB2[*i*].

FIG. 6 is an enlarged plan view of the vicinity of a pressure chamber CB1[*i*] and a pressure chamber CB2[*i*]. FIG. 6 illustrates a pressure chamber CB1[*i*−1], a pressure chamber CB2[*i*−1], the pressure chamber CB1[*i*], the pressure chamber CB2[*i*], a pressure chamber CB1[*i*+1], and a pressure chamber CB2[*i*+1].

A portion of the pressure chamber CB2 overlaps and the other portion does not overlap the pressure chamber CB1 corresponding to the pressure chamber CB2 as viewed in the −X direction. In the example of FIG. 6, a portion Pa3 of the pressure chamber CB2[*i*−1] in the −X direction does not overlap the pressure chamber CB1[*i*−1], and a portion Pa4 of the pressure chamber CB2[*i*−1] in the −X direction overlaps the pressure chamber CB1[*i*−1].

1.4 Conclusion of Embodiment

As described above, the liquid ejecting head 1 according to the present embodiment includes the pressure chamber CB1 that extends in the −X direction and applies pressure to the ink, the pressure chamber CB2 that extends in the −X direction and applies pressure to the ink, the nozzle channel RN that communicates with the nozzle N for ejecting the ink, the communication channel RR1 that extends in the −Z direction and enables the pressure chamber CB1 and the nozzle channel RN to communicate with each other, and the communication channel RR2 that extends in the −Z direction and enables the pressure chamber CB2 and the nozzle channel RN to communicate with each other, in which the nozzle channel RN includes the first portion U1 that extends in the −X direction and communicates with the communication channel RR1 and the second portion U2 that extends in the V1 direction crossing the −X direction and the −Z direction and communicates with at least the first portion U1, and angle θ1 formed between the −X direction and the V1 direction is larger than 0° and smaller than 90°.

Since higher resolution generally results in a reduction in width of a partition between nozzle channels RN, so-called structural crosstalk by which a change in internal pressure of a certain nozzle channel RN has an influence on ink ejection of a nozzle channel RN adjacent to the certain nozzle channel RN occurs. In the liquid ejecting head 1 according to the present embodiment, when a partition of the second portion U2 is inclined relative to a partition of the first portion U1 by angle θ1, the partition of the first portion U1 and the partition of the second portion U2 form a shape as in a so-called truss structure. Thus, in the liquid ejecting head 1 according to the present embodiment, strength of a partition between nozzle channels RN is improved compared with an aspect in which angle θ1 is 0°. When the partition of the second portion U2 is inclined relative to the partition of the first portion U1 by angle θ1, the flow rate of the ink flowing in the nozzle channel RN is temporarily reduced particularly in the boundary B12 between the first portion U1 and the second portion U2. Therefore, a change itself in internal pressure of a certain nozzle channel RN is also reduced. As a result, it is possible to suppress an occurrence of structural crosstalk. Suppression of an occurrence of structural crosstalk enables suppression of a deterioration in quality of an image formed on the surface of the medium PP.

Note that, in the present embodiment, the pressure chamber CB1 is an example of "a first pressure chamber", the pressure chamber CB2 is an example of "a second pressure chamber", the communication channel RR1 is an example of "a first communication channel", the communication channel RR2 is an example of "a second communication channel", the ink is an example of "a liquid", the +X direction is an example of "a first direction", the −Z direction is an example of "a second direction", and the V1 direction is an example of "a third direction".

Moreover, in the liquid ejecting head 1 according to the present embodiment, the nozzle channel RN may further include the third portion U3 that extends in the −X direction and enables the second portion U2 and the communication channel RR2 to communicate with each other.

Since the third portion U3 extends in the −X direction and the second portion U2 extends in the V1 direction, the partition of the second portion U2 is also inclined relative to a partition of the third portion U3 by angle θ1. Thus, such a relationship between the second portion U2 and the third portion U3 is also able to achieve improvement of partition strength and a reduction in flow rate similarly to the aforementioned relationship between the first portion U1 and the second portion U2. Accordingly, the liquid ejecting head 1 according to the present embodiment is able to suppress an occurrence of structural crosstalk compared with an aspect in which the second portion U2 is not inclined relative to the third portion U3, in other words, the aspect in which angle θ1 is 0°.

Moreover, in the liquid ejecting head 1 according to the present embodiment, channel length L2 may be shorter than channel length L1 and channel length L3.

Rigidity of an object generally has a feature of monotonously increasing when the dimension of the object is reduced. Since channel length L2 is shorter than channel length L1 and channel length L3, rigidity of the partition of the second portion U2 is greater than rigidity of the partition of the first portion U1 and rigidity of the partition of the third partition U3. Additionally, when channel length L2 is short, a reduction in flow rate in the boundary B12 between the first portion U1 and the second portion U2 and a reduction in flow rate in the boundary B23 between the second portion U2 and the third portion U3 are achieved in a short time, thus making it possible to continuously reduce the flow rate of the ink in the entire second portion U2. As a result, it is possible to suppress an occurrence of structural crosstalk compared with an aspect in which the channel length L2 is identical to channel length L1 and channel length L3.

Moreover, in the liquid ejecting head 1 according to the present embodiment, channel length L1 and channel length L3 may be substantially equal to each other.

Thus, according to the present embodiment, when the nozzle N communicates with the nozzle channel RN at a substantially central position, the length of an ink channel that extends from the pressure chamber CB1 to the nozzle N via the communication channel RR1 and the nozzle channel RN is able to be substantially identical to the length of an ink channel that extends from the pressure chamber CB2 to the nozzle N via the communication channel RR2 and the nozzle channel RN. Thereby, according to the present embodiment, it is possible to simplify control for ejecting the ink filled in the pressure chamber CB1 from the nozzle N and control for ejecting the ink filled in the pressure chamber CB2 from the nozzle N, for example, compared with an aspect in which channel length L1 and channel length L3 differ from each other.

Moreover, in the liquid ejecting head 1 according to the present embodiment, angle θ1 between the −X direction and the V1 direction may be larger than 10° and smaller than 50°.

Thus, the liquid ejecting head 1 according to the present embodiment is able to improve strength of a partition between nozzle channels RN and suppress an occurrence of structural crosstalk compared with the aspect in which angle θ1 is 0°.

In an aspect in which angle θ1 is 90°, air bubbles readily remain in the vicinity of a portion in which the wall surface HU1*b* and the wall surface HU2*b* are coupled compared with the liquid ejecting head 1 according to the present embodiment. In a case in which air bubbles remain in the circulation channel such as the nozzle channel RN, even when the piezoelectric element PZq is driven with the driving signal Com, for example, due to air bubbles absorbing the pressure applied from the piezoelectric element PZq for pushing out the ink, a so-called ejection abnormality that makes it difficult for the ink to be ejected from the nozzle N occurs. When an ejection abnormality occurs, the quality of an image formed on the medium PP is deteriorated. On the other hand, in the liquid ejecting head 1 according to the present embodiment, since air bubbles are difficult to remain, it is possible to suppress a deterioration in quality of an image formed on the medium PP compared with an aspect in which angle θ1 is 90°.

Moreover, in the liquid ejecting head 1 according to the present embodiment, a portion of the communication channel RR2 may overlap and the other portion may not overlap the communication channel RR1 corresponding to the communication channel RR2 as viewed in the −X direction.

In an aspect in which the communication channel RR2 does not overlap the entire communication channel RR1 as viewed in the −X direction, the width of the second portion U2 that extends in the V1 direction is widened or angle θ1 increases (close to 90°). In the former case, the liquid ejecting head 1 increases in size in the X-axis direction and the Y-axis direction. In the latter case, with the increase in angle θ1, a distance between partitions of second portions U2 of nozzle channels RN that are adjacent to each other is reduced, and therefore, an influence of structural crosstalk becomes significant, which may cancel the effect of reducing structural crosstalk obtained by improvement of partition strength and by a reduction in flow rate. As a result, the present embodiment is able to achieve the effect of preventing a size increase and reducing structural crosstalk compared with an aspect in which the communication channel RR2 does not overlap the entire communication channel RR1 as viewed in the −X direction.

Moreover, in the liquid ejecting head 1 according to the present embodiment, a portion of the pressure chamber CB2 may overlap and the other portion may not overlap the pressure chamber CB1 as viewed in the −X direction.

Therefore, the shape of the ink channel that extends from the pressure chamber CB1 to the nozzle N via the communication channel RR1 and the nozzle channel RN is able to be substantially identical to the shape of the ink channel that extends from the pressure chamber CB2 to the nozzle N via the communication channel RR2 and the nozzle channel RN. Thereby, according to the present embodiment, it is possible to simplify control for ejecting the ink filled in the pressure chamber CB1 from the nozzle N and control for ejecting the ink filled in the pressure chamber CB2 from the nozzle N, for example, compared with an aspect in which the pressure chamber CB2 overlaps the entire pressure chamber CB1 as viewed in the −X direction.

Moreover, in the liquid ejecting head 1 according to the present embodiment, the nozzle N may be provided in the second portion U2. The nozzle N is typically provided at a substantially central position of the second portion U2.

According to an aspect in which the nozzle N is provided at the substantially central position of the second portion U2, the shape of the ink channel that extends from the pressure chamber CB1 to the nozzle N via the communication channel RR1 and the nozzle channel RN is able to be substantially identical to the shape of the ink channel that extends from the pressure chamber CB2 to the nozzle N via the communication channel RR2 and the nozzle channel RN. Thereby, according to the present embodiment, it is possible to simplify control for ejecting the ink filled in the pressure chamber CB1 from the nozzle N and control for ejecting the ink filled in the pressure chamber CB2 from the nozzle N, for example, compared with an aspect in which the nozzle N communicates with the nozzle channel RN at a position different from the central position of the nozzle channel RN.

Note that, although the first portion U1 is described in the present embodiment as a portion that communicates with the communication channel RR1 on the supply side, the first portion U1 may be considered as a portion that communicates with the communication channel RR2 on the discharge side. In this case, in the present embodiment, the third portion U3 communicates with the communication channel on the supply side.

Moreover, the liquid ejecting head 1 according to the present embodiment may further include the pressure chamber substrate 3 in which the pressure chamber CB1 and the pressure chamber CB2 are provided, the communication plate 2 in which the nozzle channel RN, the communication channel RR1, and the communication channel RR2 are provided, and the nozzle substrate 60 in which the nozzle N is provided.

Therefore, according to the present embodiment, it is possible to manufacture the pressure chamber CB1, the pressure chamber CB2, the nozzle channel RN, the communication channel RR1, the communication channel RR2, and the nozzle N by using a semiconductor manufacturing technique. Thus, according to the present embodiment, it is possible to achieve miniaturization and densification of the pressure chamber CB1, the pressure chamber CB2, the nozzle channel RN, the communication channel RR1, the communication channel RR2, and the nozzle N.

Moreover, the liquid ejecting head 1 according to the present embodiment may include the piezoelectric element PZ1 that applies pressure to the ink in the pressure chamber CB1 in response to supply of the driving signal Com1 and the piezoelectric element PZ2 that applies pressure to the ink in the pressure chamber CB2 in response to supply of the driving signal Com2.

Therefore, according to the present embodiment, it is possible to increase the amount of the ink ejected from the nozzle N compared with an aspect in which only the piezoelectric element PZq that applies pressure to the ink in one pressure chamber CBq is provided.

Note that, in the present embodiment, the piezoelectric element PZ1 is an example of "a first element", the piezoelectric element PZ2 is an example of "a second element", the driving signal Com1 is an example of "a first driving signal", and the driving signal Com2 is an example of "a second driving signal".

Moreover, in the liquid ejecting head 1 according to the present embodiment, the waveform of the driving signal Com1 and the waveform of the driving signal Com2 may be substantially identical.

Therefore, according to the present embodiment, it is possible to simplify control for ejecting the ink filled in the pressure chamber CB1 from the nozzle N and control for ejecting the ink filled in the pressure chamber CB2 from the nozzle N compared with an aspect in which the waveform of the driving signal Com 1 differs from the waveform of the driving signal Com2.

2. Modified Examples

Each aspect exemplified above can be variously modified. Specific modified aspects will be exemplified below. Any two or more aspects selected from the following examples can be appropriately combined as long as the aspects do not contradict each other.

2.1. First Modified Example

Although an aspect in which channel width w1, channel width w2, and channel width w3 are all substantially equal is exemplified in the embodiment described above, the disclosure is not limited to the aspect. For example, channel width w2 may be narrower than channel width w1 and channel width w3.

Figure 7:
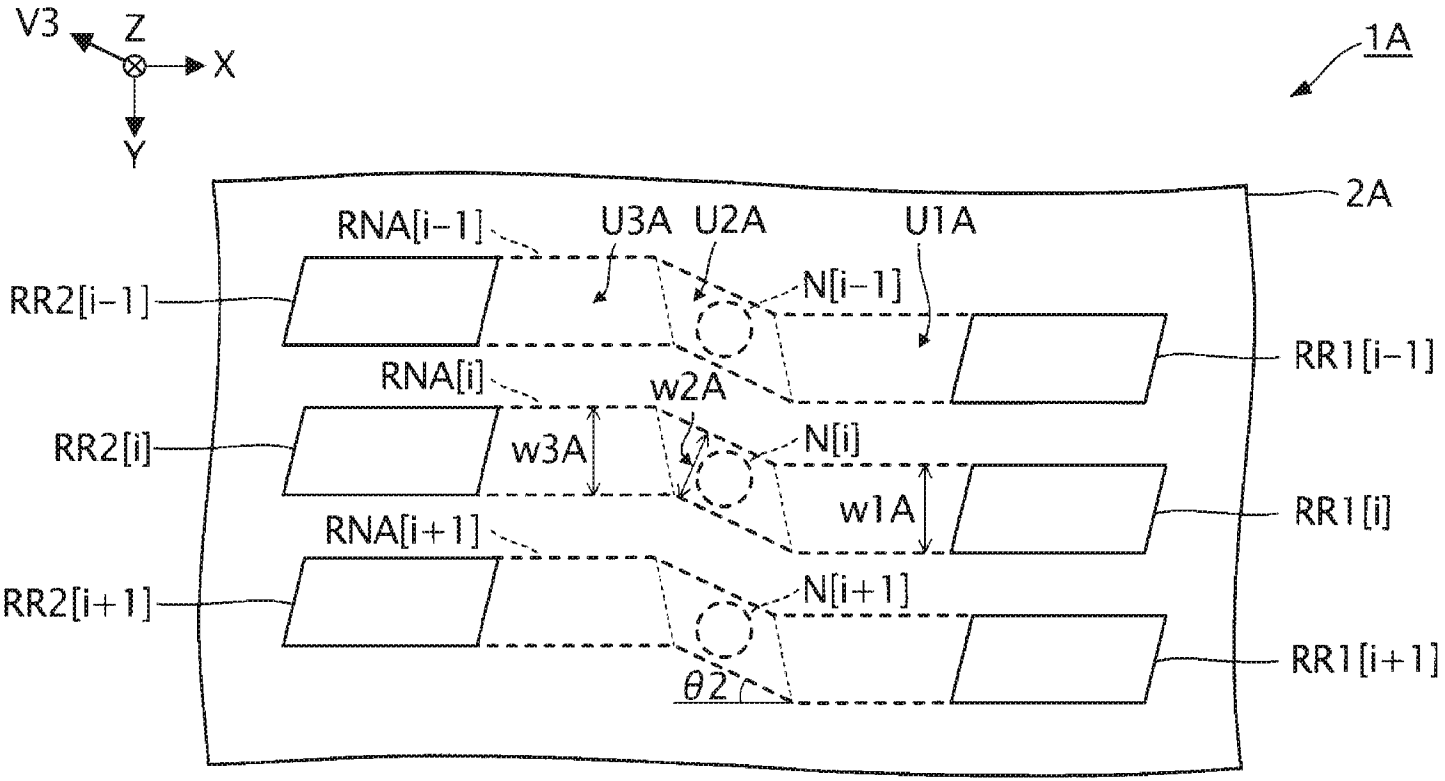
FIG. 7 is an enlarged plan view of the vicinity of a nozzle channel RN[i] according to a first modified example.

FIG. 7 is an enlarged plan view of the vicinity of the nozzle channel RN[i] according to a first modified example. A liquid ejecting head 1A according to the first modified example is similar in configuration to the liquid ejecting head 1 except that a communication plate 2A is provided instead of the communication plate 2.

As illustrated in FIG. 7, a nozzle channel RNA provided in the communication plate 2A has a first portion U1A, a second portion U2A, and a third portion U3A. The second portion U2A extends in the V3 direction. The V3 direction crosses the −X direction and is orthogonal to the −Z direction. Angle θ2 formed between the −X direction and the V3 direction is larger than 0° and smaller than 90°. Channel width w2A of the second portion U2A is narrower than channel width w1A of the first portion U1A and channel width w3A of the third portion U3A.

As described above, in the liquid ejecting head 1A according to the first modified example, channel width w2A is narrower than channel width w1A and channel width w3A. Therefore, the flow rate of the ink in the second portion U2A is higher than the flow rate of the ink in the first portion U1A and the flow rate of the ink in the third portion U3A. Thus, the ink in the second portion U2A is able to flow before an increase in viscosity of the ink proceeds compared with the ink in the first portion U1A and the ink in the third portion U3A, and it is possible to prevent an occurrence of an ejection abnormality that makes it difficult for the ink to be ejected from the nozzle N due to an increase in viscosity of the ink.

Further, since channel width w2A is narrower than channel width w1A and channel width w3A, a partition of the second portion U2A is thicker than a partition of the first portion U1A and a partition of the third portion U3A. Thus, rigidity of the partition of the second portion U2A is greater than rigidity of the partition of the first portion U1A and rigidity of the partition of the third portion U3A. In the embodiment, by inclining the second portion U2 relative to each of the first portion U1 and the third portion U3 by angle θ1, partition strength is improved and the flow rate is reduced to reduce structural crosstalk. On the other hand, in the first modified example, since channel width w2A is narrow as described above, the flow rate in the second portion U2A increases compared with that of the embodiment. However, partition strength is further improved compared with that of the embodiment, thus making it possible to reduce an occurrence of structural crosstalk similarly to the embodiment.

Note that, in the first modified example, channel width w1A is the width of the first portion U1A in the horizontal direction, channel width w2A is the width of the second portion U2A in the horizontal direction, and channel width w3A is the width of the third portion U3A in the horizontal direction, but there is no limitation thereto. For example, the channel width of the second portion U2A in the −Z direction may be narrower than the channel width of the first portion U1A in the −Z direction and the channel width of the third portion U3A in the −Z direction.

2.2. Second Modified Example

Although an aspect in which channel width w1 and channel width w3 are substantially equal to each other is exemplified in the embodiment and the first modified example described above, the disclosure is not limited to the aspect. For example, channel width w3 may be narrower than channel width w1.

Figure 8:
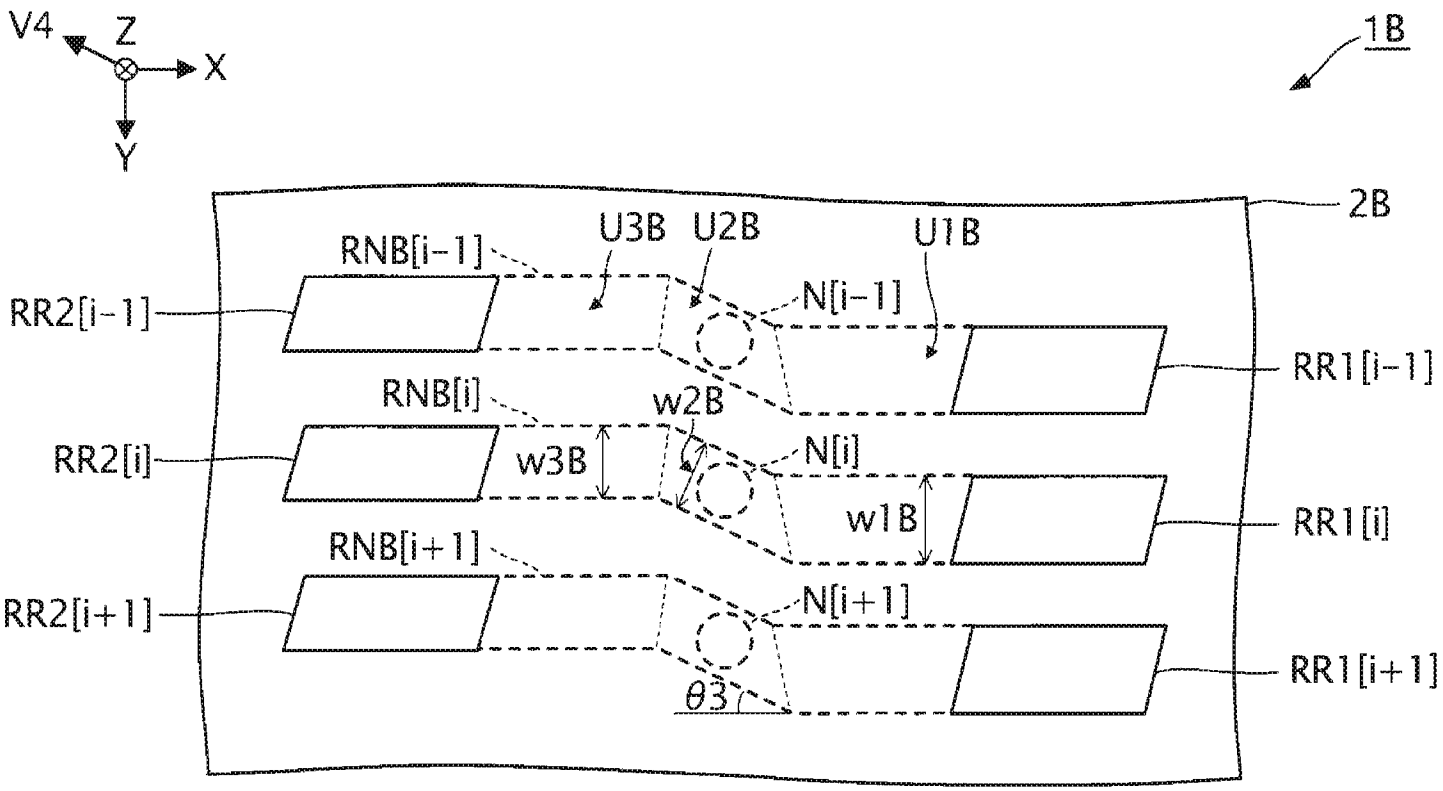
FIG. 8 is an enlarged plan view of the vicinity of a nozzle channel RN[i] according to a second modified example.

FIG. 8 is an enlarged plan view of the vicinity of a nozzle channel RN[i] according to a second modified example. A liquid ejecting head 1B according to the second modified example is similar in configuration to the liquid ejecting head 1 except that a communication plate 2B is provided instead of the communication plate 2.

As illustrated in FIG. 8, a nozzle channel RNB provided in the communication plate 2B has a first portion U1B, a second portion U2B, and a third portion U3B. The second portion U2B extends in the V4 direction. The V4 direction crosses the −X direction and is orthogonal to the −Z direction. Angle θ3 formed between the −X direction and the V4 direction is larger than 0° and smaller than 90°. Channel width w3B of the third portion U3B is narrower than channel width w1B of the first portion U1B.

As described above, in the liquid ejecting head 1B according to the second modified example, channel width w3B is narrower than channel width w1B. Since channel width w3B is narrower than channel width w1B, the flow rate of the ink in the third portion U3B is higher than the flow rate of the ink in the first portion U1B. Thus, the liquid ejecting head 1B according to the second modified example is able to smoothly discharge air bubbles in the ink compared with an aspect in which channel width w3B and channel width w1B are identical. Additionally, since it is possible to thicken a partition of the third portion U3B, structural crosstalk is able to be further suppressed.

Note that, in the second modified example, channel width w3B may be narrower than channel width w2B, may be identical to channel width w2B, or may be wider than channel width w2B.

2.3. Third Modified Example

Although an aspect in which a portion of the pressure chamber CB2 overlaps and the other portion does not overlap the pressure chamber CB1 as viewed in the −X direction is exemplified in the embodiment, the first modified example, and the second modified example described above, the disclosure is not limited to the aspect. For example, the entire pressure chamber CB2 may overlap the pressure chamber CB1 as viewed in the −X direction.

Figure 9:
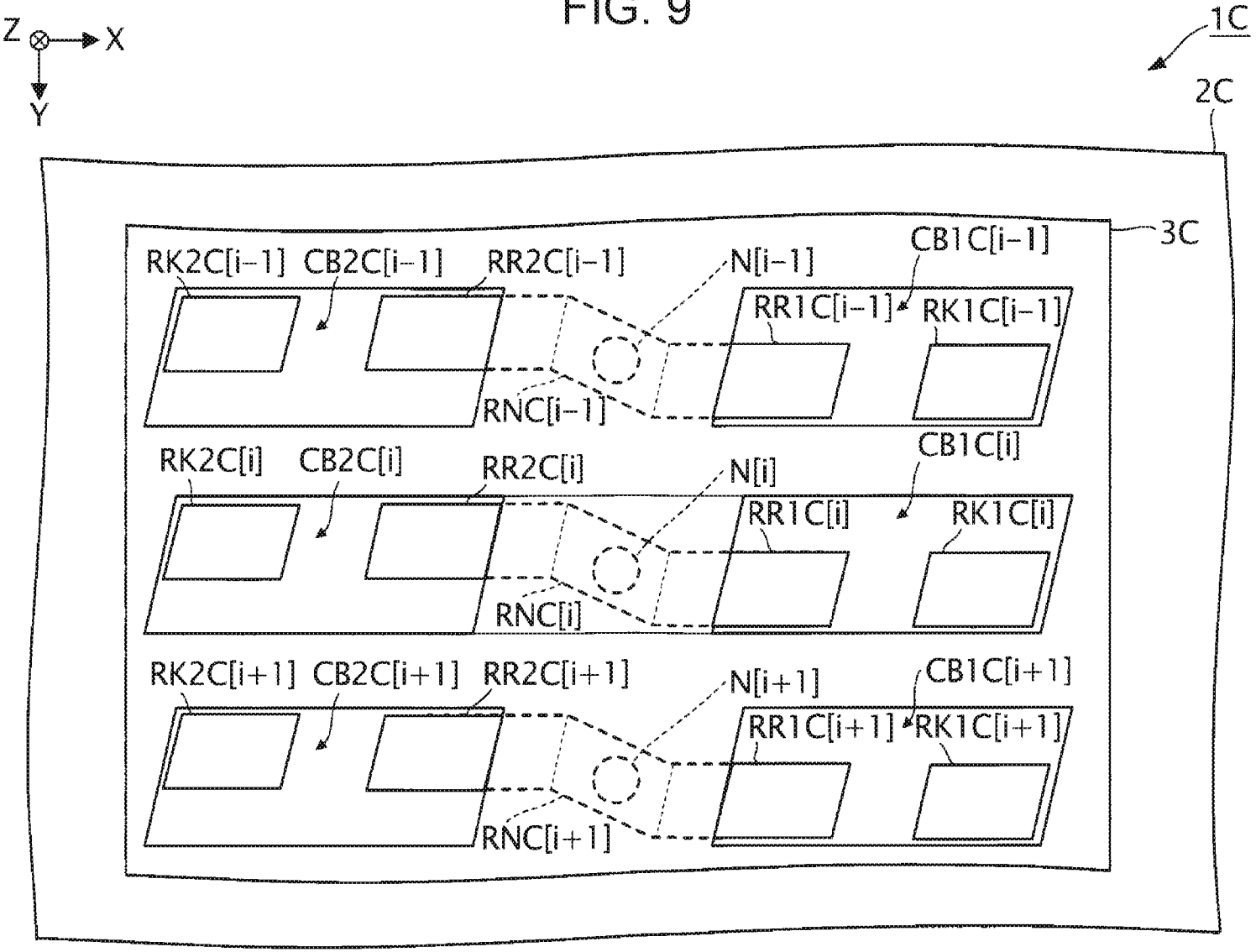
FIG. 9 is an enlarged plan view of the vicinity of a pressure chamber CB1C[i] and a pressure chamber CB2C[i] according to a third modified example.

FIG. 9 is an enlarged plan view of the vicinity of a pressure chamber CB1C[i] and a pressure chamber CB2C[i] according to a third modified example. A liquid ejecting head 1C according to the third modified example is similar in configuration to the liquid ejecting head 1 except that a pressure chamber substrate 3C is provided instead of the pressure chamber substrate 3 and that a communication plate 2C is provided instead of the communication plate 2.

As illustrated in FIG. 9, M pressure chambers CB1C corresponding on a one-to-one basis to the M nozzles N and M pressure chambers CB2C corresponding on a one-to-one basis to the M nozzles N are formed in the pressure chamber substrate 3C.

As illustrated in FIG. 9, an entire pressure chamber CB2C overlaps a pressure chamber CB1C as viewed in the −X direction. In the example of FIG. 9, the X-coordinate of a wall surface of the pressure chamber CB2C[i] on the −Y side is substantially identical to the X-coordinate of a wall surface of the pressure chamber CB1C[i] on the −Y side. Additionally, the X-coordinate of a wall surface of the pressure chamber CB2C[i] on the +Y side is substantially identical to the X-coordinate of a wall surface of the pressure chamber CB1C[i] on the +Y side.

In the communication plate 2C, M coupling channels RK1C corresponding on a one-to-one basis to the M nozzles N, M coupling channels RK2C corresponding on a one-to-one basis to the M nozzles N, M communication channels RR1C corresponding on a one-to-one basis to the M nozzles N, M communication channels RR2C corresponding on a one-to-one basis to the M nozzles N, and M nozzle channels RNC corresponding on a one-to-one basis to the M nozzles N are formed.

The nozzle channels RNC and the nozzle channels RN are identical in shape. Note that, for achieving a smooth flow of the ink, the nozzle channels RNC are positioned such that all openings of the communication channels RR1C and all openings of the communication channels RR2C in the −Z direction overlap the pressure chambers CB1C as viewed in the Z-axis direction. The coupling channels RK1C are positioned such that all openings of the coupling channels RK1C in the −Z direction overlap the pressure chambers CB1C as viewed in the Z-axis direction. The coupling channels RK2C are positioned such that all openings of the coupling channels RK2C in −Z direction overlap the pressure chambers CB2C as viewed in the Z-axis direction.

As described above, in the liquid ejecting head 1C according to the third modified example, the entire pressure chamber CB2C overlaps the pressure chamber CB1C as viewed in the −X direction. Thus, since the X-coordinate of the pressure chamber CB1C and the X-coordinate of the pressure chamber CB2C are substantially identical to each other, it is possible to easily manufacture the liquid ejecting head 1C compared with an aspect in which the pressure chamber CB2C does not overlap at least a portion of the pressure chamber CB1C as viewed in the −X direction.

2.4. Fourth Modified Example

Although the nozzle channel RN has the first portion U1, the second portion U2, and the third portion U3 in the embodiment and the first to third modified examples described above, there is no limitation thereto. For example, the nozzle channel RN may have only the first portion U1 and the second portion U2.

Figure 10:
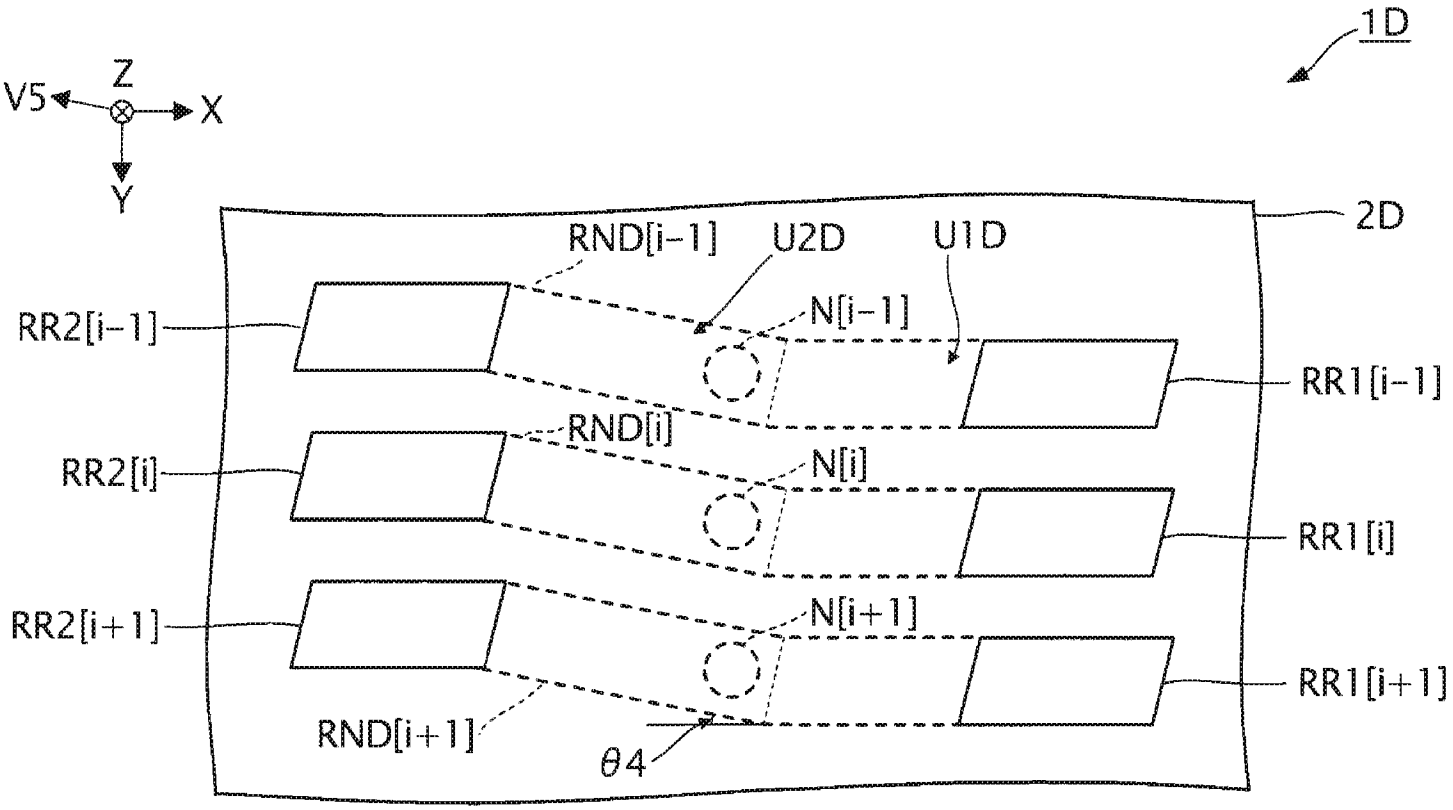
FIG. 10 is an enlarged plan view of the vicinity of a nozzle channel RN[i] according to a fourth modified example.

FIG. 10 is an enlarged plan view of the vicinity of a nozzle channel RN[i] according to a fourth modified example. A liquid ejecting head 1D according to the fourth modified example is similar in configuration to the liquid ejecting head 1 except that a communication plate 2D is provided instead of the communication plate 2.

As illustrated in FIG. 10, a nozzle channel RND provided in the communication plate 2D has a first portion U1D and a second portion U2D. The first portion U1D extends in the −X direction and communicates with the communication channel RR1. The second portion U2D extends in the V5 direction and communicates with the first portion U1D and the communication channel RR2. The V5 direction crosses the −X direction and is orthogonal to the −Z direction. Angle 04 formed between the −X direction and the V5 direction is larger than 0° and smaller than 90°.

As described above, in the liquid ejecting head 1D according to the fourth modified example, the second portion U2D may communicate with the communication channel RR2. Also in the fourth modified example, a partition of the first portion U1D and a partition of the second portion U2D form a shape as in a so-called truss structure. Thus, the liquid ejecting head 1D according to the fourth modified example is able to improve strength of a partition between nozzle channels RND and suppress an occurrence of structural crosstalk compared with an aspect in which angle θ4 formed between the −X direction and the V5 direction is 0°. Additionally, the direction in which the ink flows in the nozzle channel RND changes once, whereas the direction in which the ink flows in the nozzle channel RN changes twice. Accordingly, the fourth modified example is able to achieve a smooth flow of the ink compared with the embodiment.

Note that, although an aspect in which the first portion U1D that communicates with the communication channel RR1 extends in the −X direction and the second portion U2D that communicates with the communication channel RR2 extends in the V5 direction is described here, the first portion U1D may extend in the V5 direction and the second portion U2D may extend in the −X direction.

2.5. Fifth Modified Example

Although an aspect in which two piezoelectric elements PZq of the piezoelectric element PZ1 and the piezoelectric element PZ2 are provided so as to correspond to each of the nozzles N is exemplified in the embodiment and the first to fourth modified examples described above, the disclosure is not limited to the aspect. For example, one piezoelectric element PZ may be provided so as to correspond to each of the nozzles N.

Figure 11:
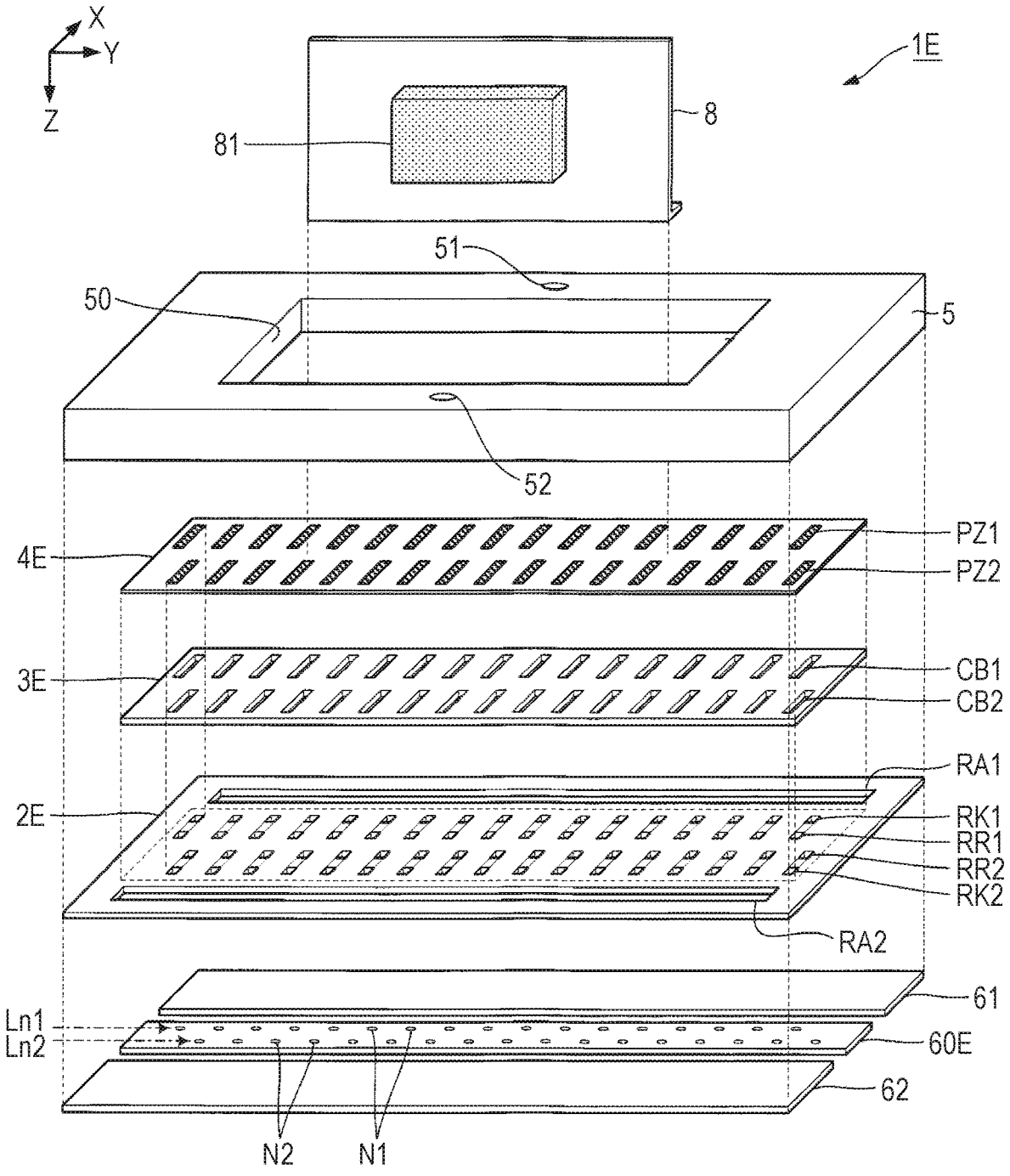
FIG. 11 is an exploded perspective view of a liquid ejecting head 1E according to a fifth modified example.

FIG. 11 is an exploded perspective view of a liquid ejecting head 1E according to a fifth modified example.

As illustrated in FIG. 11, the liquid ejecting head 1E according to the fifth modified example differs from the liquid ejecting head 1 according to the embodiment in terms of including a nozzle substrate 60E instead of the nozzle substrate 60, including a communication plate 2E instead of the communication plate 2, including a pressure chamber substrate 3E instead of the pressure chamber substrate 3, and including a vibrating plate 4E instead of the vibrating plate 4.

Among these, the nozzle substrate 60E differs from the nozzle substrate 60 according to the embodiment in terms of including a nozzle row Ln1 and a nozzle row Ln2 instead of the nozzle row Ln. Here, the nozzle row Ln1 is a set of M1 nozzles N that are provided so as to extend in the Y-axis direction. The nozzle row Ln2 is a set of M2 nozzles N that are provided so as to extend in the Y-axis direction at a position closer than the nozzle row Ln1 to the discharge channel RA2. Here, values of M1 and M2 are natural numbers of 1 or more that satisfy M1+M2=M. Note that, in the present modified example, a case in which the value of M is a natural number of 2 or more is assumed. Moreover, in the following description, the nozzles N that form the nozzle row Ln1 are sometimes referred to as nozzles N1, and the nozzles N that form the nozzle row Ln2 are sometimes referred to as nozzles N2.

The communication plate 2E differs from the communication plate 2 according to the embodiment in terms of including M1 coupling channels RK1 corresponding on a one-to-one basis to M1 nozzles N1, M2 coupling channels RK2 corresponding on a one-to-one basis to M2 nozzles N2, M1 communication channels RR1 corresponding on a one-to-one basis to the M1 nozzles N1, and M2 communication channels RR2 corresponding on a one-to-one basis to the M2 nozzles N2 instead of the M coupling channels RK1, the M coupling channels RK2, the M communication channels RR1, and the M communication channels RR2. Further, the supply channel RA1 that extends in the Y-axis direction and the discharge channel RA2 that is provided, in the −X direction as viewed from the supply channel RA1, so as to extend in the Y-axis direction are formed in the communication plate 2E, similarly to the communication plate 2.

Moreover, the pressure chamber substrate 3E differs from the pressure chamber substrate 3 according to the embodiment in that M1 pressure chambers CB1 corresponding on a one-to-one basis to the M1 nozzles N1 and M2 pressure chambers CB2 corresponding on a one-to-one basis to the M2 nozzles N2 are formed instead of the M pressure chambers CB1 and the M pressure chambers CB2.

Moreover, the vibrating plate 4E differs from the vibrating plate 4 according to the embodiment in that M1 piezoelectric elements PZ1 corresponding on a one-to-one basis to the M1 nozzles N1 and M2 piezoelectric elements PZ2 corresponding on a one-to-one basis to the M2 nozzles N2 are formed instead of the M piezoelectric elements PZ1 and the M piezoelectric elements PZ2.

Figure 12:
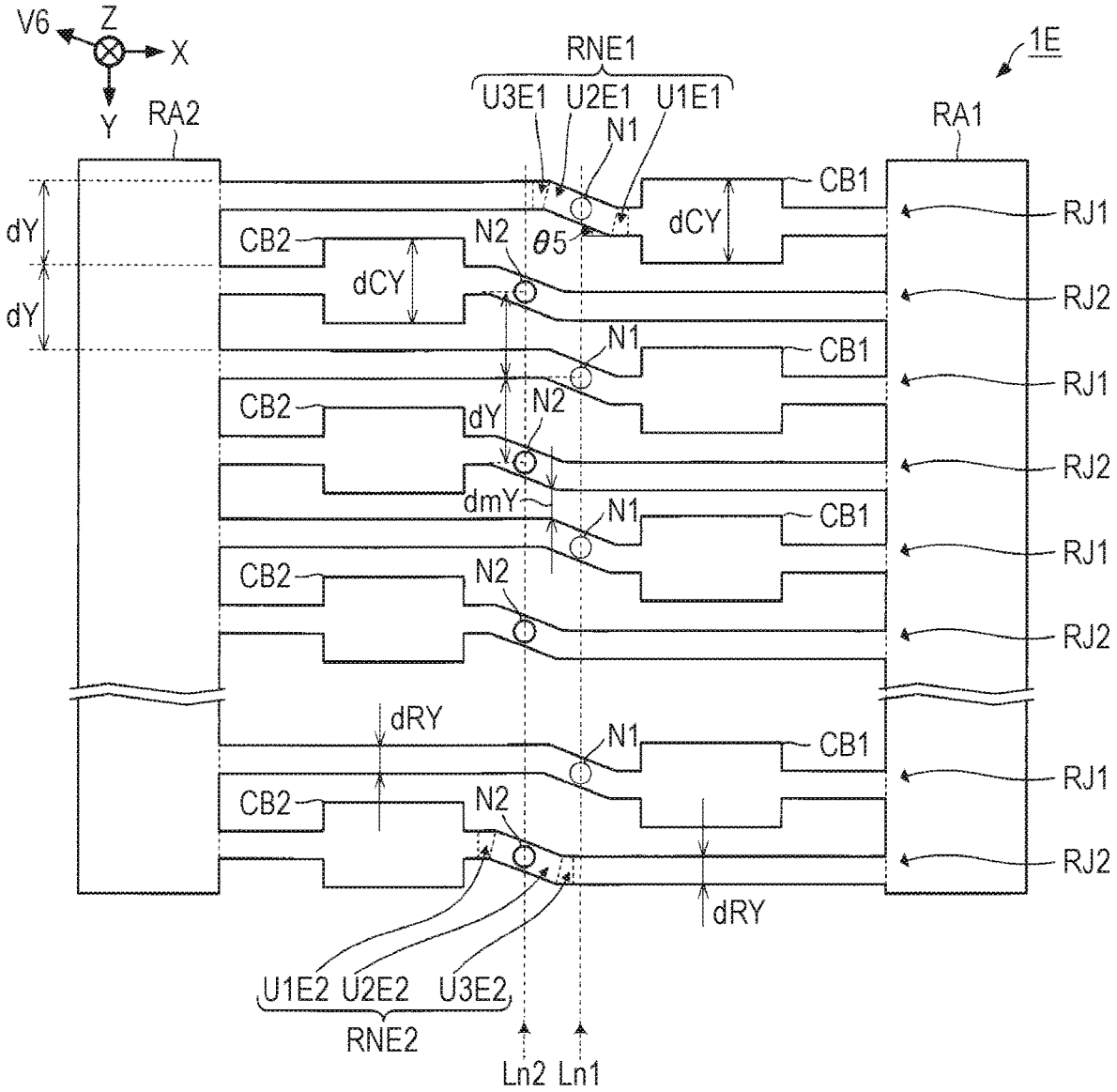
FIG. 12 is a plan view of the liquid ejecting head 1E according to the fifth modified example.

FIG. 12 is a plan view of the liquid ejecting head 1E as viewed in the Z-axis direction.

In the fifth modified example, the liquid ejecting head 1E includes M circulation channels RJ corresponding on a one-to-one basis to the M nozzles N provided in the nozzle substrates 60E. In the following description, circulation channels RJ provided so as to correspond to the nozzles N1 are sometimes referred to as circulation channels RJ1, and circulation channels RJ provided so as to correspond to the nozzles N2 are sometimes referred to as circulation channels RJ2. That is, in the fifth modified example, M1 circulation channels RJ1 and M2 circulation channels RJ2 enable the supply channel RA1 and the discharge channel RA2 to communicate with each other.

In the fifth modified example, a circulation channel RJ1 and a circulation channel RJ2 are alternately arranged in the Y-axis direction. Moreover, in the fifth modified example, the M1 circulation channels RJ1 and the M2 circulation channels RJ2 are arranged such that a distance between the circulation channel RJ1 and the circulation channel RJ2 that are adjacent to each other in the Y-axis direction is distance dY.

As described above, the circulation channel RJ1 has the pressure chamber CB1, and the circulation channel RJ2 has the pressure chamber CB2. In the fifth modified example, as illustrated in FIG. 12, the pressure chamber CB1 is provided at a position closer than a nozzle N1 to the supply channel RA1 as viewed in the Z-axis direction. The pressure chamber CB2 is provided at a position closer than a nozzle N2 to the discharge channel RA2 as viewed in the Z-axis direction. As described above, the nozzle row Ln1 to which the nozzles N1 belong is provided on the +X side of the nozzle row Ln2 to which the nozzles N2 belong. Therefore, in the fifth modified example, the pressure chamber CB1 is positioned on the +X side of the pressure chamber CB2.

In the fifth modified example, the circulation channel RJ is provided such that the width of the pressure chamber CBq in the Y-axis direction is width dCY and the width of a portion other than the pressure chamber CBq is width dRY or less. Further, in the fifth modified example, as an example, a case in which the M1 circulation channels RJ1 and the M2 circulation channels RJ2 are provided such that distance dY and width dCY satisfy dCY>dY and distance dY and width dRY satisfy dRY>dY is assumed. Note that, although an aspect in which distance dY and width dRY satisfy dY>dRY is described in FIG. 12 for simplification and easy understanding, distance dY and width dRY may satisfy dRY>dY, or the width of at least some of the portion other than the pressure chamber CBq may be larger than distance dY. Further, in the fifth modified example, a case in which a distance from a nozzle N1 to a nozzle N2 adjacent thereto in the −Y direction and a distance from the nozzle N2 to an adjacent nozzle N1 in the −Y direction are substantially identical to each other as width dY is assumed.

As described with reference to FIGS. 13 and 14, in the fifth modified example, the circulation channel RJ1 and the circulation channel RJ2 that are adjacent to each other in the Y-axis direction hardly overlap each other in the Z-axis direction at any positions in the X-axis direction. Therefore, substantially no structural crosstalk occurs between the circulation channel RJ1 and the circulation channel RJ2, and it is sufficient that only structural crosstalk between two circulation channels RJ1 with the circulation channel RJ2 therebetween or structural crosstalk between two circulation channels RJ2 with the circulation channel RJ1 therebetween be considered. Thus, a pitch at which circulation channels RJ are provided is able to be narrowed compared with an aspect in which the pressure chamber CB1 and the pressure chamber CB2 are provided at the same position in the X-axis direction. In addition, according to the fifth modified example, it is also possible to reduce channel resistance while narrowing the pitch at which circulation channels RJ are provided. Further, according to the fifth modified example, it is also possible to ensure capacities of the pressure chamber CB1 and the pressure chamber CB2 by increasing width dCY of the pressure chamber CB1 and the pressure chamber CB2 in the Y-axis direction while narrowing the pitch at which circulation channels RJ are provided.

Further, in the fifth modified example, the circulation channel RJ1 includes a nozzle channel RNE1. The nozzle channel RNE1 has a first portion U1E1, a second portion U2E1, and a third portion U3E1. The first portion U1E1 extends in the −X direction and communicates with the communication channel RR1. The second portion U2E1 extends in the V6 direction and communicates with the first portion U1E1. The V6 direction crosses the −X direction and is orthogonal to the −Z direction. Angle θ5 formed between the −X direction and the V6 direction is larger than 0° and smaller than 90°. The second portion U2E1 communicates with the nozzle N1. The third portion U3E1 extends in the −X direction and communicates with the second portion U2E1 and a channel R11. The channel R11 will be described later with reference to FIG. 13.

The circulation channel RJ2 includes a nozzle channel RNE2. The nozzle channel RNE2 has a first portion U1E2, a second portion U2E2, and a third portion U3E2. The first portion U1E2 extends in the −X direction and communicates with the communication channel RR2. The second portion U2E2 extends in the V6 direction and communicates with the first portion U1E2. The second portion U2E2 communicates with the nozzle N2. The third portion U3E2 extends in the −X direction and communicates with the second portion U2E2 and a channel R21. The channel R21 will be described later with reference to FIG. 14. The X-coordinate of the center of the nozzle channel RNE1 differs from the X-coordinate of the center of the nozzle channel RNE2.

Figure 13:
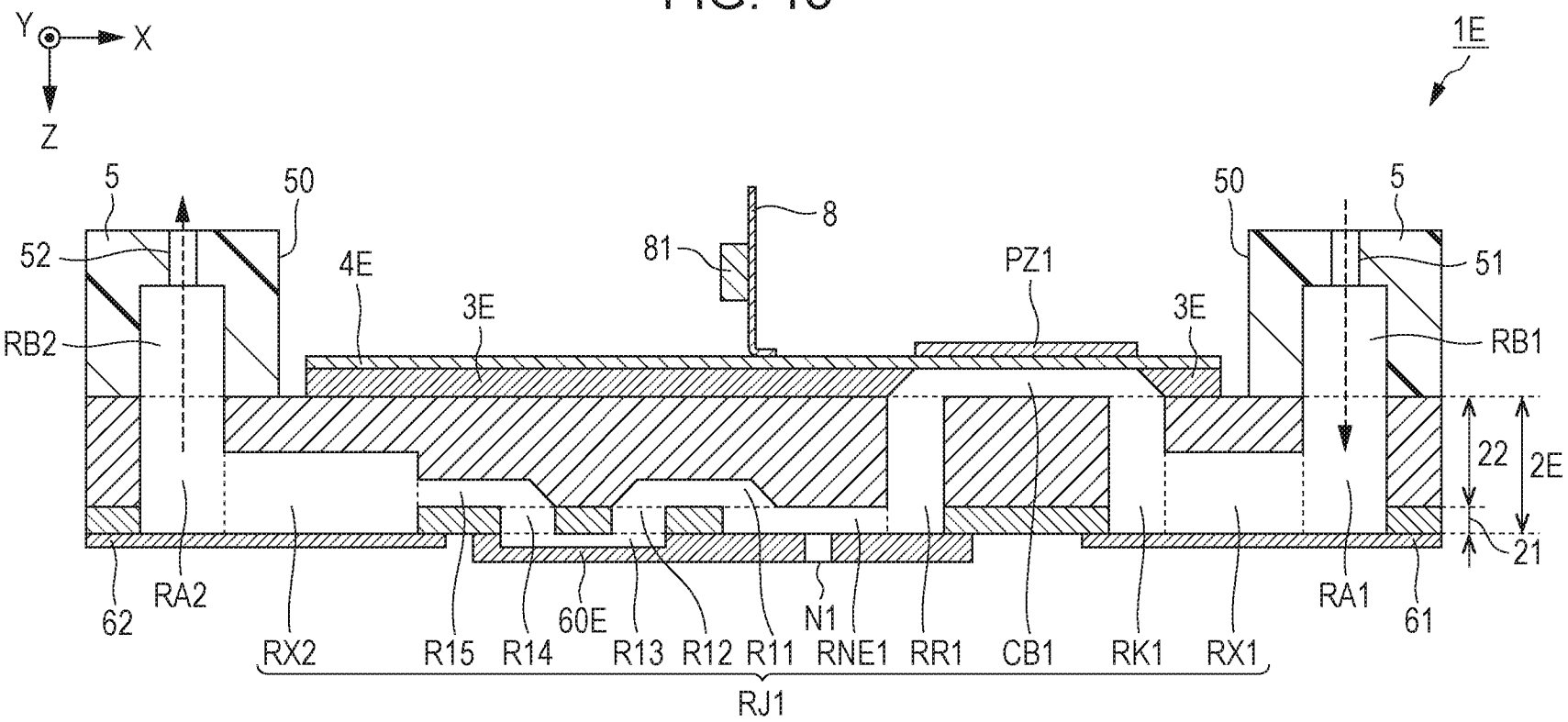
FIG. 13 is a sectional view of the liquid ejecting head 1E according to the fifth modified example.

FIG. 13 is a sectional view of the liquid ejecting head 1E, which is taken parallel to the X-Z plane so as to pass through the circulation channel RJ1. FIG. 14 is a sectional view of the liquid ejecting head 1E, which is taken parallel to the X-Z plane so as to pass through the circulation channel RJ2.

Figure 14:
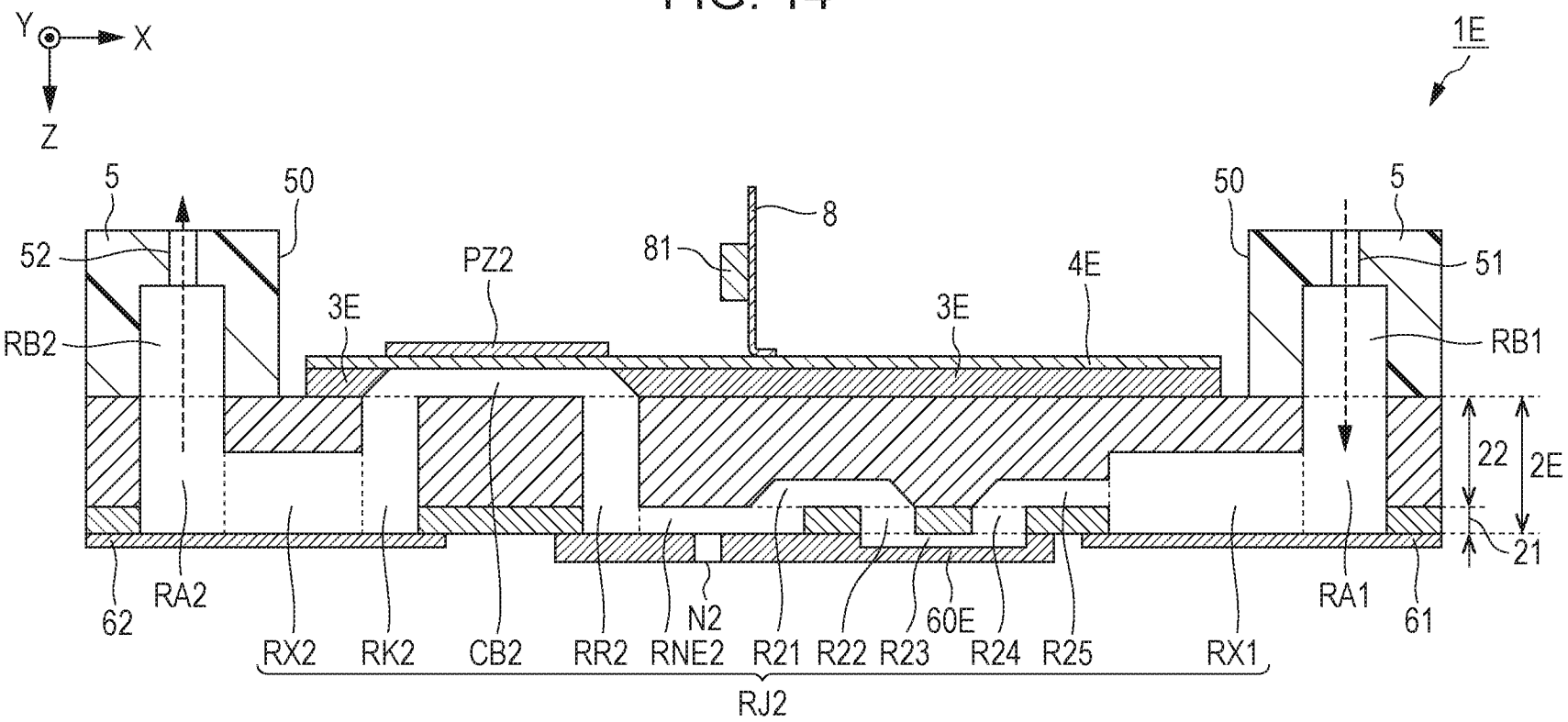
FIG. 14 is a sectional view of the liquid ejecting head 1E according to the fifth modified example.

As illustrated in FIGS. 13 and 14, in the fifth modified example, the communication plate 2E includes a substrate 21 and a substrate 22. Here, each of the substrate 21 and the substrate 22 is manufactured such that, for example, a silicon monocrystalline substrate is processed by using a semiconductor manufacturing technique such as etching. Note that any known material and process can be adopted to manufacture each of the substrate 21 and the substrate 22.

As illustrated in FIG. 13, in the fifth modified example, the circulation channel RJ1 includes the coupling channel RX1, the coupling channel RK1, the pressure chamber CB1, the communication channel RR1, the nozzle channel RNE1, the channel R11, a channel R12, a channel R13, a channel R14, a channel R15, and the coupling channel RX2. The coupling channel RX1 communicates with the supply channel RA1 and is formed in the substrate 21 and the substrate 22. The coupling channel RK1 communicates with the coupling channel RX1 and is formed in the substrate 21 and the substrate 22. The pressure chamber CB1 communicates with the coupling channel RK1 and is formed in the pressure chamber substrate 3E. The communication channel RR1 communicates with the pressure chamber CB1 and is formed in the substrate 21 and the substrate 22. The nozzle channel RNE1 communicates with the communication channel RR1 and the nozzle N1 and is formed in the substrate 21. The channel R11 communicates with the nozzle channel RNE1 and is formed in the substrate 22. The channel R12 communicates with the channel R11 and is formed in the substrate 21. The channel R13 communicates with the channel R12 and is formed in the nozzle substrate 60E. The channel R14 communicates with the channel R13 and is formed in the substrate 21. The channel R15 communicates with the channel R14 and is formed in the substrate 22. The coupling channel RX2 enables the channel R15 and the discharge channel RA2 to communicate with each other and is formed in the substrate 21 and the substrate 22.

As illustrated in FIG. 14, in the fifth modified example, the circulation channel RJ2 includes the coupling channel RX2, the coupling channel RK2, the pressure chamber CB2, the communication channel RR2, the nozzle channel RNE2, the channel R21, a channel R22, a channel R23, a channel R24, a channel R25, and the coupling channel RX1. The coupling channel RX2 communicates with the discharge channel RA2 and is formed in the substrate 21 and the substrate 22. The coupling channel RK2 communicates with the coupling channel RX2 and is formed in the substrate 21 and the substrate 22. The pressure chamber CB2 communicates with the coupling channel RK2 and is formed in the pressure chamber substrate 3E. The communication channel RR2 communicates with the pressure chamber CB2 and is formed in the substrate 21 and the substrate 22. The nozzle channel RNE2 communicates with the communication channel RR2 and the nozzle N2 and is formed in the substrate 21. The channel R21 communicates with the nozzle channel RNE2 and is formed in the substrate 22. The channel R22 communicates with the channel R21 and is formed in the substrate 21. The channel R23 communicates with the channel R22 and is formed in the nozzle substrate 60E. The channel R24 communicates with the channel R23 and is formed in the substrate 21. The channel R25 communicates with the channel R24 and is formed in the substrate 22. The coupling channel RX1 enables the channel R25 and the supply channel RA1 to communicate with each other and is formed in the substrate 21 and the substrate 22.

According to the fifth modified example, a partition of the second portion U2E1 is inclined relative to a partition of the first portion U1E1 by angle θ5. The partition of the second portion U2E1 is also inclined relative to a partition of the third portion U3E1 by angle θ5. A partition of the second portion U2E2 is inclined relative to a partition of the first portion U1E2 by angle θ5. The partition of the second portion U2E2 is also inclined relative to a partition of the third portion U3E2 by angle θ5. Accordingly, according to the fifth modified example, it is possible to improve partition strength and reduce the flow rate of the ink, thus making it possible to suppress an occurrence of structural crosstalk compared with an aspect in which angle θ5 formed between the −X direction and the V6 direction is 0°.

2.6. Sixth Modified Example

In the fifth modified example described above, the X-coordinate of the center of the nozzle channel RNE1 and the X-coordinate of the center of the nozzle channel RNE2 differ from each other but may be identical to each other.

Figure 15:
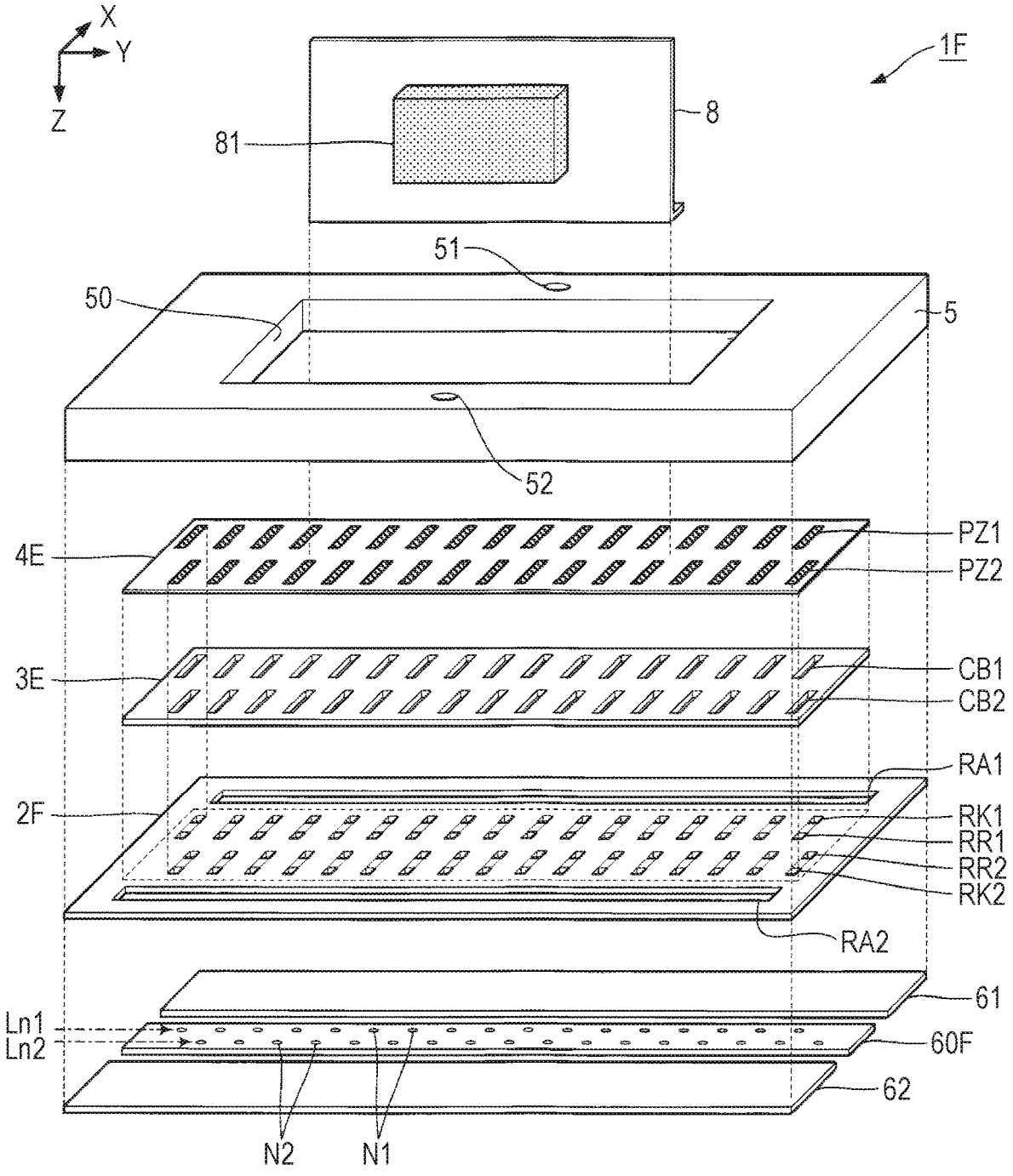
FIG. 15 is an exploded perspective view of a liquid ejecting head 1F according to a sixth modified example.

FIG. 15 is an exploded perspective view of a liquid ejecting head 1F according to a sixth modified example.

As illustrated in FIG. 15, the liquid ejecting head 1F according to the sixth modified example differs from the liquid ejecting head 1E according to the fifth modified example in terms of including a nozzle substrate 60F instead of the nozzle substrate 60E and including a communication plate 2F instead of the communication plate 2E.

The nozzle substrate 60F differs from the nozzle substrate 60E according to the fifth modified example in that a distance from a nozzle N1 to a nozzle N2 adjacent thereto and a distance from the nozzle N2 to an adjacent nozzle N1 in the −Y direction differ from each other.

The communication plate 2F differs from the communication plate 2E according to the fifth modified example in that the shape of a nozzle channel RNF1 provided in the communication plate 2F differs from the shape of the nozzle channel RNE1 provided in the communication plate 2E according to the fifth modified example and that the shape of a nozzle channel RNF2 provided in the communication plate 2F differs from the shape of the nozzle channel RNE2 provided in the communication plate 2E according to the fifth modified example.

Figure 16:
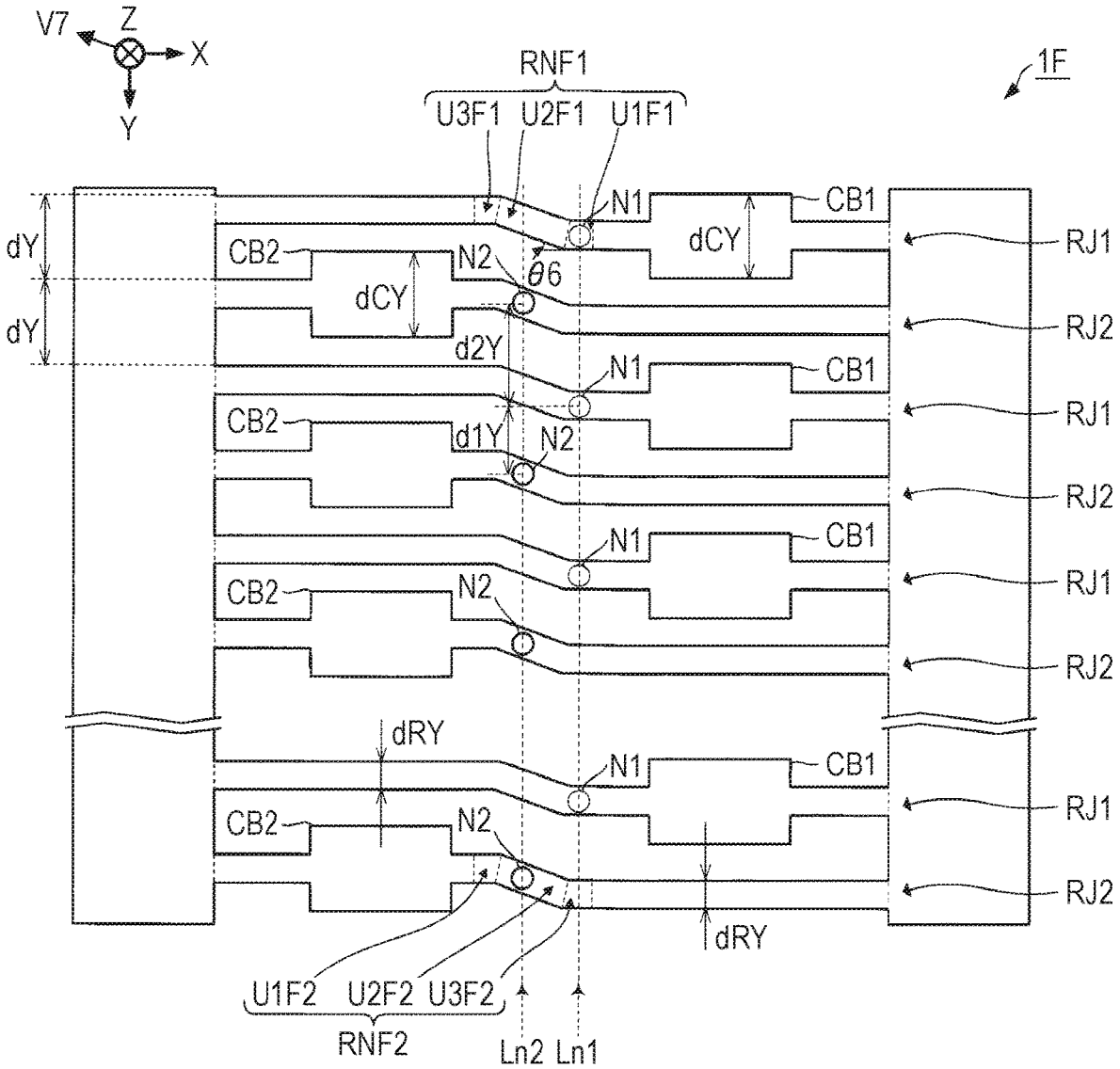
FIG. 16 is a plan view of the liquid ejecting head 1F as viewed in the Z-axis direction.

FIG. 16 is a plan view of the liquid ejecting head 1F as viewed in the Z-axis direction.

Also in the sixth modified example, similarly to the fifth modified example, the circulation channel RJ is provided such that the width of the pressure chamber CBq in the Y-axis direction is width dCY and the width of a portion other than the pressure chamber CBq is width dRY or less. In the sixth modified example, as an example, a case in which the M1 circulation channels RJ1 and the M2 circulation channels RJ2 are provided such that distance dY and width dCY satisfy dCY>dY and distance dY and width dRY satisfy dRY>dY is assumed. Note that, although FIG. 16 describes, for simplification and easy understanding, as if distance dY and width dRY satisfied dY>dRY, distance dY and width dRY actually satisfy dRY>dY, and the width of at least some of the portion other than the pressure chamber CBq may be larger than distance dY. Further, in the sixth modified example, distance d1Y from a nozzle N1 to a nozzle N2 adjacent thereto and distance d2Y from the nozzle N2 to an adjacent nozzle N1 in the −Y direction differ from each other.

Also in the sixth modified example, similarly to the fifth modified example, the circulation channel RJ1 and the circulation channel RJ2 that are adjacent to each other in the Y-axis direction hardly overlap each other in the Z-axis direction at any positions in the X-axis direction. Therefore, substantially no structural crosstalk occurs between the circulation channel RJ1 and the circulation channel RJ2, and it is sufficient that only structural crosstalk between two circulation channels RJ1 with the circulation channel RJ2 therebetween or structural crosstalk between two circulation channels RJ2 with the circulation channel RJ1 therebetween be considered. Thus, a pitch at which circulation channels RJ are provided is able to be narrowed compared with an aspect in which the pressure chamber CB1 and the pressure chamber CB2 are provided at the same position in the X-axis direction. In addition, according to the sixth modified example, it is also possible to reduce channel resistance or the like while narrowing the pitch at which circulation channels RJ are provided. Further, according to the sixth modified example, it is also possible to ensure capacities of the pressure chamber CB1 and the pressure chamber CB2 by increasing width dCY of the pressure chamber CB1 and the pressure chamber CB2 in the Y-axis direction while narrowing the pitch at which circulation channels RJ are provided.

Further, in the sixth modified example, the circulation channel RJ1 includes the nozzle channel RNF1. The nozzle channel RNF1 has a first portion U1F1, a second portion U2F1, and a third portion U3F1. The first portion U1F1 extends in the −X direction and communicates with the communication channel RR1. The first portion U1F1 communicates with the nozzle N1. The second portion U2F1 extends in the V7 direction and communicates with the first portion U1F1. The V7 direction crosses the −X direction and is orthogonal to the −Z direction. Angle θ6 formed between the −X direction and the V7 direction is larger than 0° and smaller than 90°. The third portion U3F1 extends in the −X direction and communicates with the second portion U2F1 and the channel R11.

The circulation channel RJ2 includes the nozzle channel RNF2. The nozzle channel RNF2 has a first portion U1F2, a second portion U2F2, and a third portion U3F2. The first portion U1F2 extends in the −X direction and communicates with the communication channel RR2. The second portion U2F2 extends in the V7 direction and communicates with the first portion U1F2. The second portion U2F2 communicates with the nozzle N2. The third portion U3F2 extends in the −X direction and communicates with the second portion U2F2 and the channel R21. The X-coordinate of the center of the nozzle channel RNF1 and the X-coordinate of the center of the nozzle channel RNF2 are substantially identical to each other.

According to the sixth modified example, a partition of the second portion U2F1 is inclined relative to a partition of the first portion U1F1 by angle θ6. The partition of the second portion U2F1 is also inclined relative to a partition of the third portion U3F1 by angle θ6. A partition of the second portion U2F2 is inclined relative to a partition of the first portion U1F2 by angle θ6. The partition of the second portion U2F2 is also inclined relative to a partition of the third portion U3F2 by angle θ6. Accordingly, according to the sixth modified example, it is possible to improve partition strength and reduce the flow rate of the ink, thus making it possible to suppress an occurrence of structural crosstalk compared with an aspect in which angle θ6 formed between the −X direction and the V7 direction is 0°.

Further, in the sixth modified example, since the X-coordinate of the center of the nozzle channel RNF1 and the X-coordinate of the center of the nozzle channel RNF2 are substantially equal, thickness of a partition between the nozzle channel RNF1 and the nozzle channel RNF2 is able to be substantially fixed. On the other hand, in the fifth modified example, since the X-coordinate of the center of the nozzle channel RNF1 and the X-coordinate of the center of the nozzle channel RNF2 differ from each other, the thickness of the partition between the nozzle channel RNF1 and the nozzle channel RNF2 is not fixed, and there is a portion whose thickness is small like thickness dmY illustrated in FIG. 12 compared with that of the other portion. In the portion whose thickness is small, rigidity is small, and structural crosstalk is likely to occur compared with the other portion. In the sixth modified example, a portion whose thickness is smaller than the other portion is less likely to be generated, thus making it possible to suppress an occurrence of structural crosstalk compared with the fifth modified example.

2.7. Seventh Modified Example

In the embodiment and the first to fourth modified examples described above, the ink filled in the pressure chamber CB1 and the ink filled in the pressure chamber CB2 are ejected from the nozzle N, but ink filled in only one pressure chamber CBq may be ejected from the nozzle N.

Figure 17:
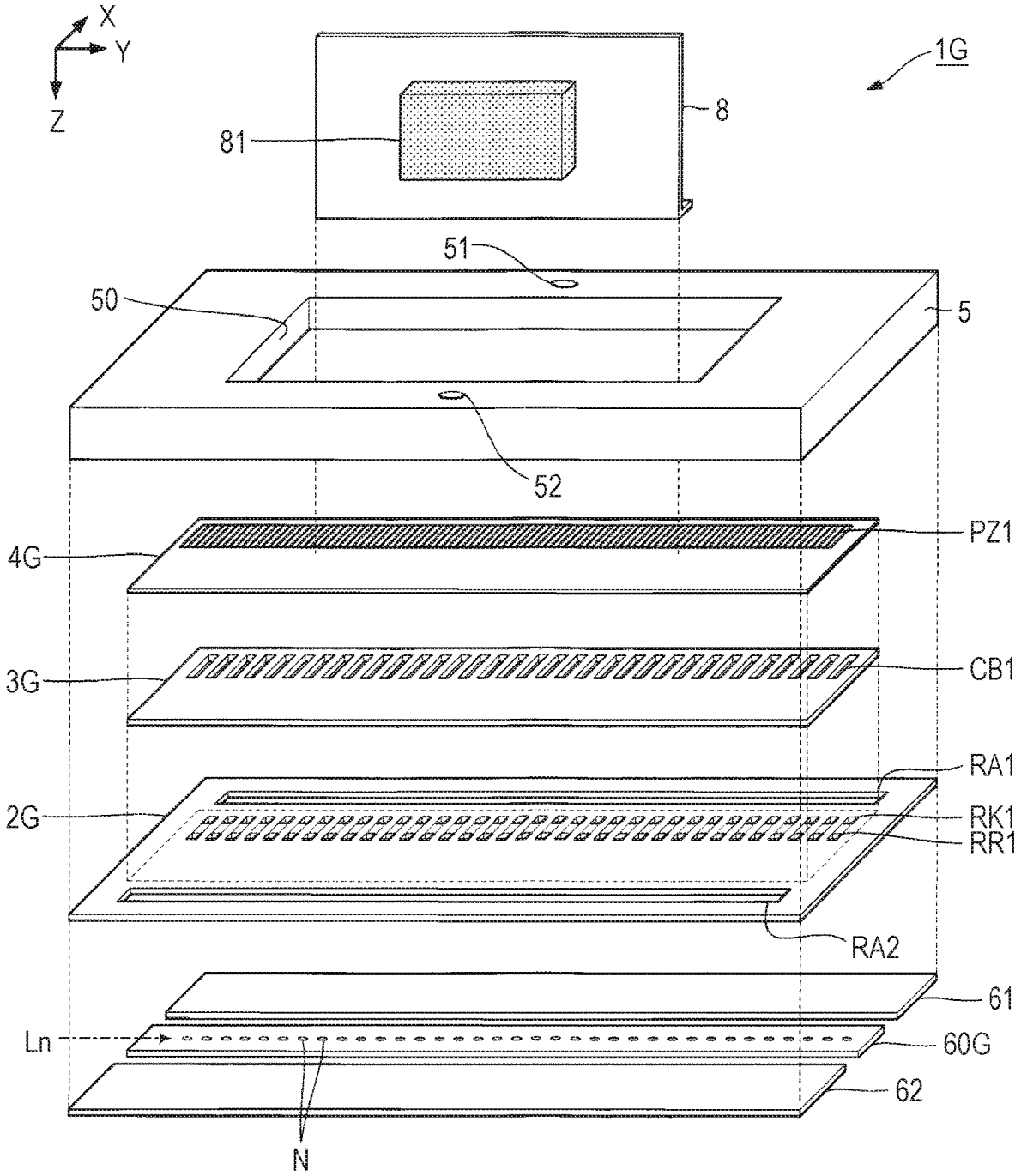
FIG. 17 is an exploded perspective view of a liquid ejecting head 1G according to a seventh modified example.

FIG. 17 is an exploded perspective view of a liquid ejecting head 1G according to a seventh modified example.

As illustrated in FIG. 17, the liquid ejecting head 1G according to the seventh modified example differs from the liquid ejecting head 1 according to the embodiment in terms of including a communication plate 2G instead of the communication plate 2, including a pressure chamber substrate 3G instead of the pressure chamber substrate 3, and including a vibrating plate 4G instead of the vibrating plate 4.

The communication plate 2G differs from the communication plate 2 according to the embodiment in terms of including neither the M coupling channels RK2 nor the M communication channels RR2 among the M coupling channels RK1, the M coupling channels RK2, the M communication channels RR1, and the M communication channels RR2.

The pressure chamber substrate 3G differs from the pressure chamber substrate 3 according to the embodiment in terms of including no M pressure chambers CB2 among the M pressure chambers CB1 and the M pressure chambers CB2.

The vibrating plate 4G differs from the vibrating plate 4 according to the embodiment in terms of including no M piezoelectric elements PZ2 among the M piezoelectric elements PZ1 and the M piezoelectric elements PZ2.

In the communication plate 2G, one supply channel RA1, one discharge channel RA2, the M coupling channels RK1, and the M communication channels RR1 are formed. An ink channel that enables the supply channel RA1 and the discharge channel RA2 to communicate with each other in the seventh modified example is referred to as a circulation channel RJG.

Figure 18:
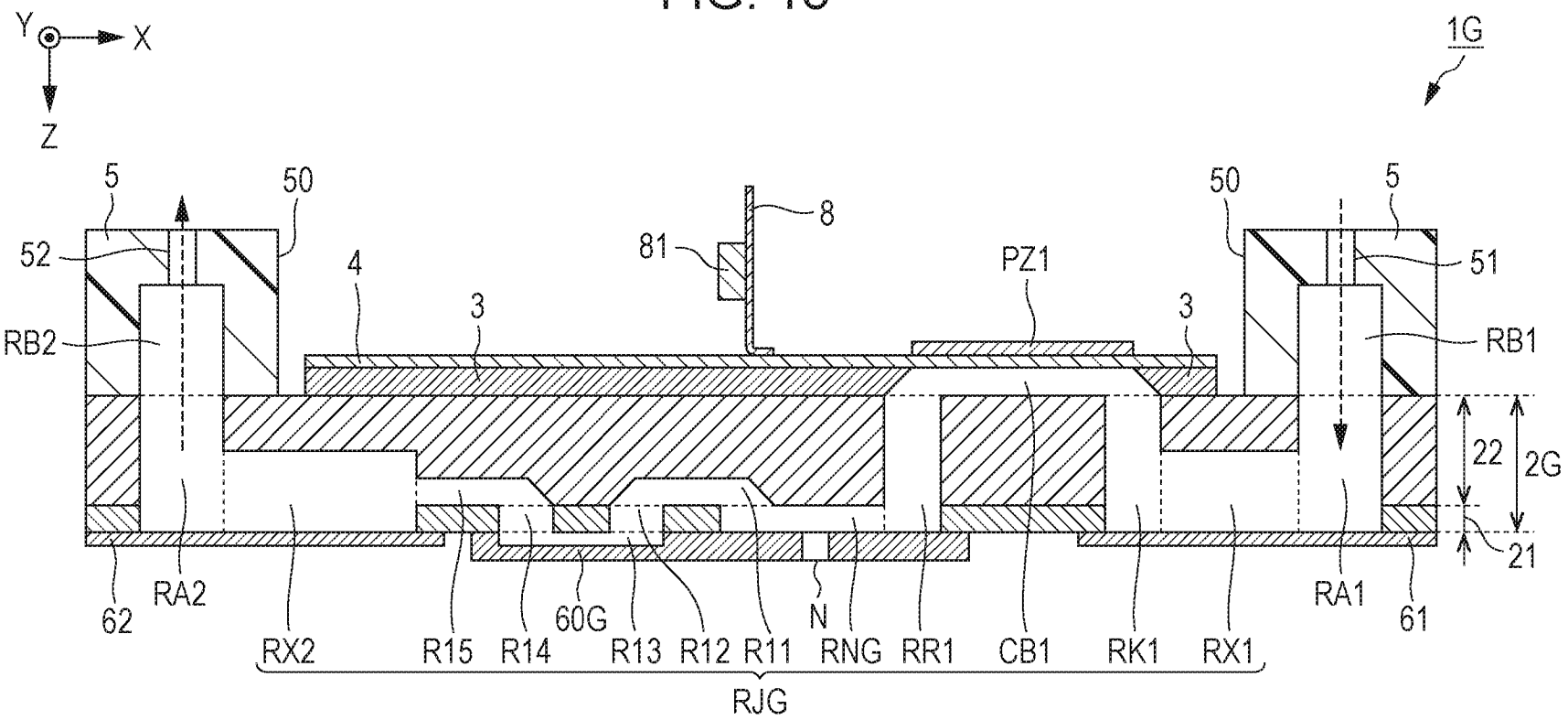
FIG. 18 is a sectional view of the liquid ejecting head 1G according to the seventh modified example.

FIG. 18 is a sectional view of the liquid ejecting head 1G, which is taken parallel to the X-Z plane so as to pass through the circulation channel RJG.

As illustrated in FIG. 18, in the seventh modified example, the communication plate 2G includes the substrate 21 and the substrate 22. Here, each of the substrate 21 and the substrate 22 is manufactured such that, for example, a silicon monocrystalline substrate is processed by using a semiconductor manufacturing technique such as etching. Note that any known material and process can be adopted to manufacture each of the substrate 21 and the substrate 22.

As illustrated in FIG. 18, in the seventh modified example, the circulation channel RJG includes the coupling channel RX1, the coupling channel RK1, the pressure chamber CB1, the communication channel RR1, a nozzle channel RNG, the channel R11, the channel R12, the channel R13, the channel R14, the channel R15, and the coupling channel RX2. The coupling channel RX1 communicates with the supply channel RA1 and is formed in the substrate 21 and the substrate 22. The coupling channel RK1 communicates with the coupling channel RX1 and is formed in the substrate 21 and the substrate 22. The pressure chamber CB1 communicates with the coupling channel RK1 and is formed in the pressure chamber substrate 3. The communication channel RR1 communicates with the pressure chamber CB1 and is formed in the substrate 21 and substrate 22. The nozzle channel RNG communicates with the communication channel RR1 and the nozzle N and is formed in the substrate 21. The channel R11 communicates with the nozzle channel RNG and is formed in the substrate 22. The channel R12 communicates with the channel R11 and is formed in the substrate 21. The channel R13 communicates with the channel R12 and is formed in a nozzle substrate 60G. The channel R14 communicates with the channel R13 and is formed in the substrate 21. The channel R15 communicates with the channel R14 and is formed in the substrate 22. The coupling channel RX2 enables the channel R15 and the discharge channel RA2 to communicate with each other and is formed in the substrate 21 and the substrate 22.

Figure 19:
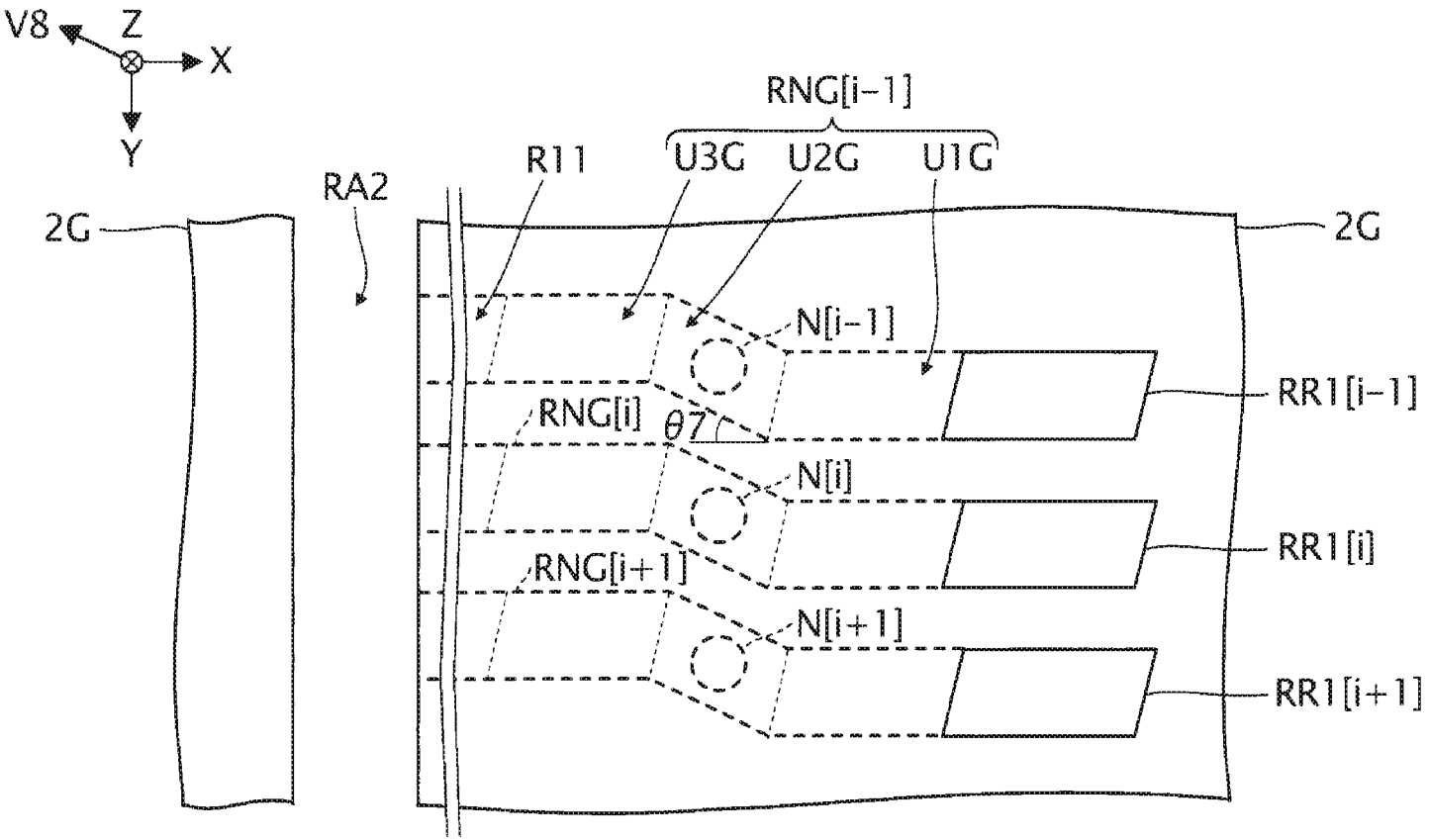
FIG. 19 is an enlarged plan view of the vicinity of a nozzle channel RNG[i].

FIG. 19 is an enlarged plan view of the vicinity of the nozzle channel RNG[i].

The nozzle channel RNG has a first portion U1G, a second portion U2G, and a third portion U3G. The first portion U1G extends in the −X direction and communicates with the communication channel RR1. The second portion U2G extends in the V8 direction and communicates with the first portion U1G. The V8 direction crosses the −X direction and is orthogonal to the −Z direction. Angle θ7 formed between the −X direction and the V8 direction is larger than 0° and smaller than 90°. The second portion U2G communicates with the nozzle N. The third portion U3G extends in the −X direction and communicates with the second portion U2G and the channel R11.

Also in the seventh modified example, a partition of the second portion U2G is inclined relative to a partition of the first portion U1G by angle θ7. The partition of the second portion U2G is inclined relative to a partition of the third portion U3G by angle θ7. Accordingly, according to the seventh modified example, it is possible to improve strength of a partition between nozzle channels RNG and suppress an occurrence of structural crosstalk compared with an aspect in which angle θ7 formed between the −X direction and the V8 direction is 0°.

Note that, in the seventh modified example, the circulation channel RJG may include the coupling channel RX1, the coupling channel RK1, the pressure chamber CB1, the communication channel RR1, the nozzle channel RNG, the channel R11, and the coupling channel RX2 and may not include the channel R12, the channel R13, the channel R14, or the channel R15. The coupling channel RX2 enables the channel R11 and the discharge channel RA2 to communicate with each other.

2.8. Eighth Modified Example

Although the liquid ejecting apparatus 100 of a serial type in which the endless belt 922 on which the liquid ejecting head 1, the liquid ejecting head 1A, the liquid ejecting head 1B, the liquid ejecting head 1C, the liquid ejecting head 1D, the liquid ejecting head 1E, the liquid ejecting head 1F, or the liquid ejecting head 1G is mounted is reciprocated in the Y-axis direction is exemplified in the embodiment and the first to seventh modified examples described above, the disclosure is not limited to such an aspect. The liquid ejecting apparatus may be a liquid ejecting apparatus of a line type in which a plurality of nozzles N are distributed over the entire width of the medium PP.

Figure 20:
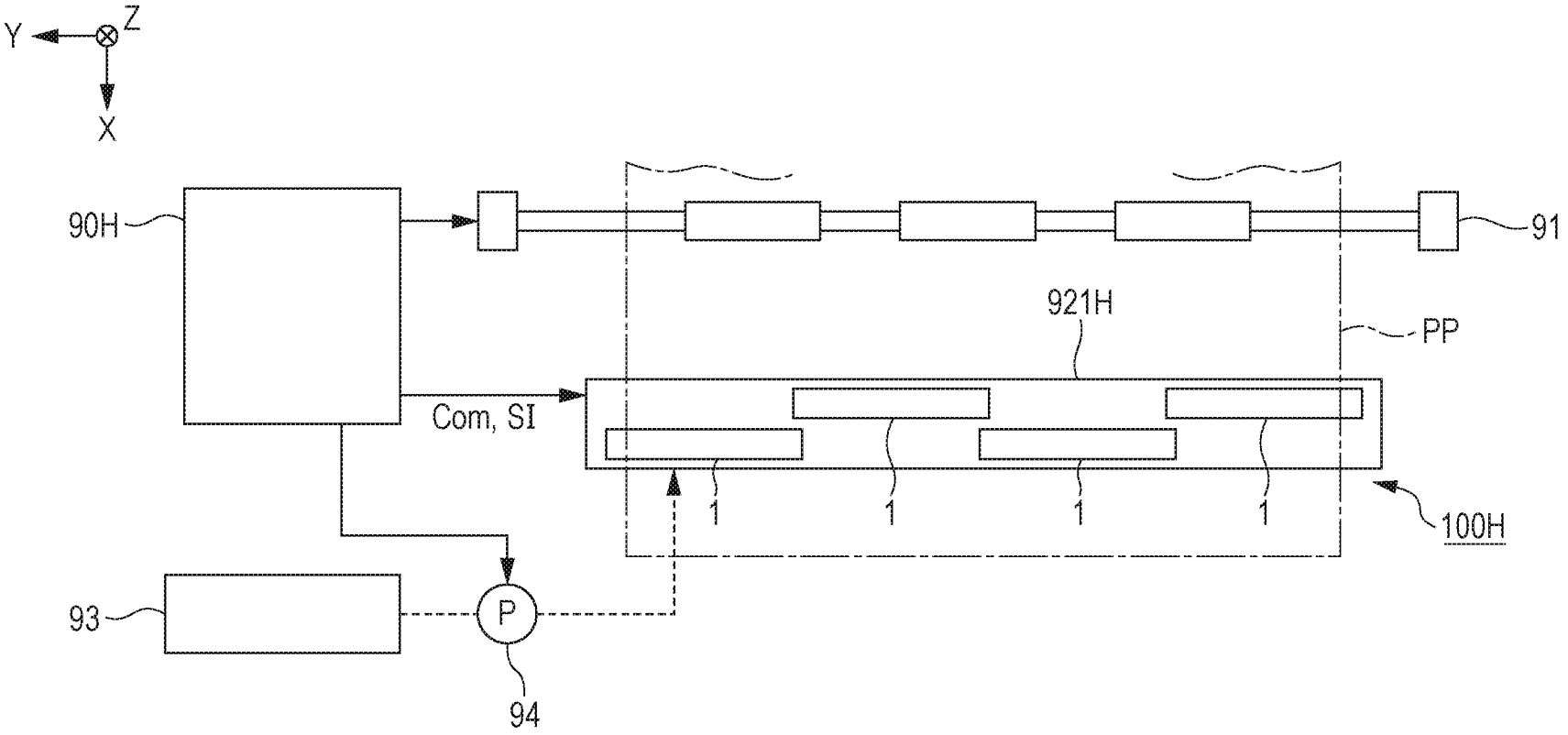
FIG. 20 illustrates an example of a configuration of a liquid ejecting apparatus 100H according to an eighth modified example.

FIG. 20 illustrates an example of a configuration of a liquid ejecting apparatus 100H according to an eighth modified example. The liquid ejecting apparatus 100H differs from the liquid ejecting apparatus 100 according to the embodiment in terms of including a control device 90H instead of the control device 90, including a storage case 921H instead of the storage case 921, and not including the endless belt 922. The control device 90H differs from the control device 90 in terms of outputting no signal for controlling the endless belt 922. The storage case 921H is provided such that the plurality of liquid ejecting heads 1 having a longitudinal direction in the Y-axis direction are distributed over the entire width of the medium PP. Note that liquid ejecting heads 1A, liquid ejecting heads 1B, liquid ejecting heads 1C, liquid ejecting heads 1D, liquid ejecting heads 1E, liquid ejecting heads 1F, or liquid ejecting heads 1G may be mounted on the storage case 921H instead of the liquid ejecting heads 1.

2.9. Ninth Modified Example

Although a piezoelectric element PZ that converts electrical energy into kinetic energy is exemplified as the energy conversion element that applies pressure to the inside of the pressure chamber CB in the embodiment and the first to eighth modified examples described above, the disclosure is not limited to such an aspect. As the energy conversion element that applies pressure to the inside of the pressure chamber CB, for example, a heating element that converts electrical energy into thermal energy, performs heating to generate air bubbles in the pressure chamber CB, and changes the pressure in the pressure chamber CB. The heating element may be, for example, an element in which a heating material generates heat in accordance with supply of the driving signal Com.

2.10. Tenth Modified Example

Although the nozzle channel RN exemplified in the embodiment, the first to third modified examples, and the fifth to seventh modified examples described above has the first portion U1, the second portion U2, and the third portion U3, the nozzle channel RN is not limited thereto and may have one or more portions in addition to the first portion U1, the second portion U2, and the third portion U3. For example, the nozzle channel RN in a tenth modified example has the first portion U1, the second portion U2, the third portion U3, and a fourth portion. The first portion U1 extends in the −X direction and communicates with the communication channel RR1. The second portion U2 extends in the V1 direction and communicates with the first portion U1. The third portion U3 extends in the direction rotated counterclockwise by angle θ1 from the −X direction as viewed in the −Z direction and communicates with the second portion U2. The fourth portion extends in the −X direction and communicates with the third portion U3 and the communication channel RR2. The nozzle N may be provided in the second portion U2 or the third portion U3.

2.11. Eleventh Modified Example

In the nozzle channel RN exemplified in the embodiment, the first to fifth modified examples, and the seventh modified example described above, the second portion U2 communicates with the nozzle N, but the first portion U1 or the third portion U3 may communicate with the nozzle N.

2.12. Twelfth Modified Example

In the embodiment and the first to fourth modified examples described above, the waveform of the driving signal Com1 and the waveform of the driving signal Com2 are substantially identical but may differ from each other.

2.13. Thirteenth Modified Example

The liquid ejecting apparatus exemplified in the embodiment and the first to ninth modified examples described above can be adopted for various apparatuses such as a facsimile apparatus and a copying machine in addition to equipment dedicated to printing. However, the liquid ejecting apparatus of the disclosure is not limited to being used for printing. For example, a liquid ejecting apparatus that ejects a solution of a color material is used as a manufacturing apparatus that forms a color filter of a liquid crystal display device. Further, a liquid ejecting apparatus that ejects a solution of a conductive material is used as a manufacturing apparatus that forms a wire and an electrode of a wiring substrate.

What is claimed is:

1. A liquid ejecting head comprising:

a first circulation channel; and a second circulation channel, wherein the first circulation channel includes:

a first pressure chamber that extends in a first direction and applies pressure to a liquid;

a first nozzle channel that communicates with a first nozzle for ejecting the liquid; and a first communication channel that extends in a second direction orthogonal to the first direction and enables the first pressure chamber and the first nozzle channel to communicate with each other, and wherein the first nozzle channel includes:

a first portion that extends in the first direction and communicates with the first communication channel and a second portion that extends in a third direction crossing the first direction and orthogonal to the second direction and communicates with the first portion, and an angle formed between the first direction and the third direction is larger than 0° and smaller than 90°.

2. The liquid ejecting head according to claim 1, wherein the first nozzle channel further includes a third portion that extends in the first direction and communicating with the second portion.

3. The liquid ejecting head according to claim 2, wherein a channel width of the second portion is narrower than a channel width of the first portion and a channel width of the third portion.

4. The liquid ejecting head according to claim 2, wherein a channel length of the second portion is shorter than a channel length of the first portion and a channel length of the third portion.

5. The liquid ejecting head according to claim 2, wherein a channel length of the first portion and a channel length of the third portion are substantially identical to each other.

6. The liquid ejecting head according to claim 1, wherein an angle formed between the first direction and the third direction is larger than 10° and smaller than 50°.

7. The liquid ejecting head according to claim 1, wherein a portion of the second communication channel overlaps and another portion of the second communication channel does not overlap the first communication channel as viewed in the first direction.

8. The liquid ejecting head according to claim 1, wherein the first nozzle is provided in the second portion.

9. The liquid ejecting head according to claim 1, wherein the second circulation channel includes:

a second pressure chamber that extends in the first direction and applies pressure to a liquid;

a second nozzle channel that communicates with a second nozzle for ejecting the liquid; and a second communication channel that extends in the second direction and enables the second pressure chamber and the second nozzle channel to communicate with each other, and wherein the second nozzle channel includes:

a fourth portion that extends in the first direction and communicates with the second communication channel and a fifth portion that extends in the third direction and communicates with the fourth portion.

10. The liquid ejecting head according to claim 9, wherein the second nozzle channel further includes a sixth portion that extends in the first direction and communicating with the fifth portion.

11. The liquid ejecting head according to claim 1, further comprising:

a supply channel which communicates with one end of the first circulation channel and one end of the second circulation channel, and along which the liquid is supplied to the first circulation channel and the second circulation channel, and a discharge channel which communicates with the other end of the first circulation channel and the other end of the second circulation channel, and along which the liquid is discharged from the first circulation channel and the second channel.

12. The liquid ejecting head according to claim 11, wherein the first pressure chamber is positioned at closer to the supply channel than the first nozzle in the first circulation channel, when seen from the second direction, the second pressure chamber is positioned at closer to the discharge channel than the second nozzle in the second circulation channel, when seen from the second direction.

13. The liquid ejecting head according to claim 12, wherein the first circulation channel and the second circulation channel are arrayed alternatively, when seen from the second direction.

14. The liquid ejecting head according to claim 1, further comprising:

a pressure chamber substrate in which the first pressure chamber is provided;

a communication plate in which the first nozzle channel and the first communication channel are provided; and a nozzle substrate in which the first nozzle is provided.

15. A liquid ejecting apparatus comprising:

a first circulation channel; and a second circulation channel, wherein the first circulation channel includes:

a first pressure chamber that extends in a first direction and applies pressure to a liquid;

a first nozzle channel that communicates with a first nozzle for ejecting the liquid;

a first communication channel that extends in a second direction orthogonal to the first direction and enables the first pressure chamber and the first nozzle channel to communicate with each other; and wherein the first nozzle channel includes:

a first portion that extends in the first direction and communicates with the first communication channel and a second portion that extends in a third direction crossing the first direction and orthogonal to the second direction and communicates with the first portion, and an angle formed between the first direction and the third direction is larger than 0° and smaller than 90°.

* * * * *